US011318731B2

(12) United States Patent
Rauh et al.

(10) Patent No.: US 11,318,731 B2
(45) **Date of Patent: *May 3, 2022**

(54) APPLICATION UNIT WITH POSITIONING DEVICE AND MAGAZINE

(71) Applicant: KOENIG & BAUER AG, Würzburg (DE)

(72) Inventors: Volker Rauh, Hettstadt (DE); Andreas Bernard, Sulzfeld (DE); Kristina Freisinger, Münster (DE); Rudolf Geldhauser, Geldersheim (DE); Lars Keil, Würzburg (DE); Michael Koblinger, Zellingen (DE)

(73) Assignee: KOENIG & BAUER AG, Würzburg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 17/283,632

(22) PCT Filed: Aug. 22, 2019

(86) PCT No.: PCT/EP2019/072465

§ 371 (c)(1),
(2) Date: Jul. 13, 2021

(87) PCT Pub. No.: WO2020/143932

PCT Pub. Date: Jul. 16, 2020

(65) Prior Publication Data

US 2021/0354441 A1 Nov. 18, 2021

(30) Foreign Application Priority Data

Jan. 8, 2019 (DE) ..... 10 2019 100 310.5

(51) Int. Cl.

| | |
|---|---|
| ***B41F 13/24*** | (2006.01) |
| ***B41F 5/24*** | (2006.01) |
| ***B41F 31/30*** | (2006.01) |

(52) U.S. Cl.
CPC ..... *B41F 13/24* (2013.01); *B41F 5/24* (2013.01); *B41F 31/30* (2013.01); *B41P 2200/12* (2013.01)

(58) Field of Classification Search
CPC .. B41F 13/24; B41F 5/24; B41F 13/30; B41P 2200/12
See application file for complete search history.

(56) References Cited

U.S. PATENT DOCUMENTS 4,309,945 A * 1/1982 Marion ..... B41F 5/24 101/247
4,502,384 A * 3/1985 Habluetzel ..... B41F 9/18 101/153

(Continued)

FOREIGN PATENT DOCUMENTS

DE 19805898 A1 11/1999
DE 19937796 A1 2/2001

(Continued)

OTHER PUBLICATIONS

International Search Report of PCT/EP2019/072465 dated Oct. 8, 2019.

*Primary Examiner* — David H Banh
(74) *Attorney, Agent, or Firm* — Mattingly & Malur, PC

(57) ABSTRACT

An application unit comprises an application mechanism with an impression cylinder, a forme cylinder, and a supply roller, along with a positioning device and a magazine for supply rollers, which magazine is located below the application mechanism. The magazine has magazine receptacles for supply rollers and a movable repositioning device, by the use of which, the magazine receptacles can be placed in different magazine positions. One of the magazine positions is a change position, and when a magazine receptacle is located in that change position, a supply roller can be transferred, with respect to a positioning direction, between (Continued)

the magazine receptacle and a remote region of a roller positioning path that connects the magazine to the application mechanism. The positioning direction deviates no more than 45 degrees from a vertical direction. One of the magazine positions is a loading position, and when a magazine receptacle is located in the loading position, a supply roller can be transferred along a loading path with respect to a loading direction, between the magazine receptacle and a loading area. The loading direction deviates no more than 30 degrees from at least one horizontal direction.

15 Claims, 25 Drawing Sheets

(56) References Cited

U.S. PATENT DOCUMENTS 6,085,650 A 7/2000 Petersen
6,142,073 A * 11/2000 Zeman ..... B41F 5/24 101/216
6,314,882 B1 11/2001 Petersen
6,324,976 B1 * 12/2001 Thoele ..... B41F 31/027 101/350.6
6,494,138 B1 12/2002 Goettling et al.
6,718,876 B1 4/2004 Williamsson
2001/0029862 A1 * 10/2001 Hofmann ..... B41F 13/20 101/479
2006/0150843 A1 * 7/2006 Rogge ..... B41F 31/307 101/350.6
2016/0129684 A1 * 5/2016 Kress ..... B41F 3/58 101/485

FOREIGN PATENT DOCUMENTS

DE 202005006367 U1 6/2005
DE 102007003975 A1 7/2008
DE 102008016598 A1 10/2009
EP 0097331 A2 1/1984
EP 1767362 A2 3/2007

* cited by examiner

APPLICATION UNIT WITH POSITIONING DEVICE AND MAGAZINE

CROSS-REFERENCE TO RELATED APPLICATIONS

This application is the US national phase, under 35 USC § 371, of PCT/EP2019/072465, filed Aug. 22, 2019; published at WO 2020/143932 A1 on Jul. 16, 2020, and claiming priority to DE 10 2019 100 310.5, filed Jan. 8, 2019, the disclosures of which are expressly incorporated herein in their entireties by reference.

FIELD OF THE INVENTION

The present invention relates to an application unit with a positioning device and a magazine. The application unit comprises at least one application mechanism, which has at least one impression cylinder, at least one forme cylinder and at least one supply roller, along with at least one positioning device. The application unit has at least one magazine which is located below the application mechanism and which is usable for the storing of supply rollers. The magazine has at least two magazine receptacles, each for receiving one supply roller. The magazine has at least one movable repositioning device, by the use of which, the at least two magazine receptacles can be moved and placed in different magazine positions.

BACKGROUND OF THE INVENTION

In flexographic printing units, anilox rollers and forme cylinders with replaceable packings are typically used. The properties of the circumferential surface of the anilox roller have considerable influence on the amount of coating medium or application fluid that is transferred. It is therefore common for the anilox roller that is used to be based on the specific print job. Various devices for installing, removing, or replacing anilox rollers are known.

From DE 20 2005 006 367 U1, an application unit with a magazine for supply rollers is known. Supply rollers are removed laterally from a storage device, lowered by means of a transport lift, and then placed in the magazine, again laterally.

Known from U.S. Pat. No. 6,718,876 B1 is an application unit in which a forme cylinder and a supply roller are mounted on a common threaded spindle and can be lowered together by the rotation of said spindle.

Known from DE 198 05 898 A1 is an application unit in which different cylinders each have their own spindle drives.

From DE 199 37 796 A1 an application unit is known in which a stationary threaded spindle is provided, on which respective cylinders can be supported via their own drives and respective drive gears.

From DE 10 2008 016 598 A1 an application unit is known, which has a magazine for supply rollers, arranged above a printing mechanism.

From DE 10 2007 003 975 A1, an application unit having a printing mechanism is known, in which a magazine with four magazine receptacles can be located above the printing mechanism, and rollers can be replaced by means of a crane between the printing mechanism and the magazine spaces.

DE 10 2005 024 502 A1 discloses a flexographic printing unit with replaceable anilox rollers. One exemplary embodiment has a positioning device with linear guidance. Another exemplary embodiment has a magazine with a movable repositioning device and multiple magazine receptacles, which can be arranged in different magazine positions.

From EP 1 767 362 A2, a flexographic printing mechanism is known, which has a roller storage area and a positioning device with pivotable and telescopically extendable actuating devices, by means of which anilox rollers can be removed upward from the printing mechanism and fed to the roller storage area.

DE 199 62 425 A1 discloses a flexographic printing unit in which anilox rollers can be raised by means of a linearly movable component of a handling apparatus. To move the roller to a storage position, a further linear movement in a direction oriented orthogonally thereto or an additional pivoting movement must be carried out.

From DE 691 22 688 T2 a flexographic printing unit is known, in which three anilox rollers are arranged in a pivotable frame and can thus be brought alternatingly into contact with a forme cylinder.

DE 198 48 773 A1 discloses a flexographic printing press with multiple printing units, a guideway being arranged in each of the printing units, on which both printing roller bearing blocks and anilox roller bearing blocks can be moved. Levers, which are used to fix removable chamber doctor blades in place, are pivotably connected to the anilox roller bearing blocks. These levers can be moved in relation to the guideway only together with the anilox roller bearing blocks.

EP 0 884 175 A2 and DE 198 19 389 A1 each disclose a flexographic printing unit that has a magazine for anilox rollers, the magazine having a holding means for each magazine receptacle, which is attached to the magazine and is rotatable therewith.

From EP 0 097 331 A2 a device for changing a forme cylinder of a gravure rotary printing press is known.

SUMMARY OF THE INVENTION

The object of the present invention is to create an application unit having a positioning device and a magazine.

The object is attained according to the invention by the provision that at least one of the magazine positions as a change position, and that, when a magazine receptacle is located in the change position, a supply roller can be transferred, in or counter to the positioning direction, between the magazine receptacle, and the region, remote from the magazine, of a roller positioning path that connects the magazine to the application mechanism. The positioning direction deviates no more than 45 degrees from at least one vertical direction. At least one of the magazine positions is a loading position. When a magazine receptacle is located in the loading position, a supply roller can be transferred along a loading path, in or counter to a loading direction, between the magazine receptacle, and a loading area. The loading direction deviates no more than 30 degrees from at least one horizontal direction.

An application unit has at least one application mechanism having at least one impression cylinder, at least one forme cylinder, and at least one supply roller, preferably along with at least one positioning device. The application unit preferably has at least one flexographic application mechanism.

The positioning device preferably has at least one linear guide. Alternatively or additionally, the application unit is preferably characterized in that the positioning device has at least one main supporting member and further preferably in that the at least one main supporting member is arranged to be movable, in particular linearly, in and/or counter to a positioning direction, preferably guided by the at least one linear guide and/or guided along the at least one linear guide, and/or in that the forme cylinder is further preferably is arranged rotatably on the at least one main supporting member by means of at least one rolling bearing. Alternatively or additionally, the application unit is preferably characterized in that the positioning device has at least one transfer supporting member and further preferably in that the at least one transfer supporting member is arranged to be movable, in particular linearly, preferably guided by the at least one linear guide and/or guided along the at least one linear guide, specifically in and/or counter to the positioning direction and, in particular, relative to the at least one main supporting member and/or relative to a frame of the flexographic application mechanism. Alternatively or additionally, the application unit is preferably characterized in that at least one component of a bearing seat, which is configured to receive a rolling bearing arranged on the at least one supply roller, is further preferably arranged on the at least one transfer supporting member. The positioning device deviates no more than 45° from at least one vertical direction. Alternatively or additionally, the application unit is preferably characterized in that the positioning direction deviates no more than 30° and/or no more than 10° and/or no more than 5° from at least one vertical direction and/or in that the positioning direction is oriented parallel to the vertical direction.

Alternatively or additionally, the application unit is preferably characterized in that at least one bearing seat provided, which is intended for bearing at least one rolling bearing of the supply roller, and in that at least one component of said bearing seat, which has at least one bearing point or bearing surface for the at least one respective rolling bearing, is permanently arranged on the respective transfer supporting member, and in that at least one further component of the bearing seat, which has at least one fixing point or fixing surface for fixing the respective rolling bearing in contact with the respective bearing point or bearing surface, is permanently arranged on a respective main supporting member. This in particular enables supply rollers to preferably be positioned particularly easily and safely.

Alternatively or additionally, the application unit is preferably characterized in that said at least one component of the bearing seat is arranged to be movable starting from a position in which the supply roller is arranged in the supply position, supported by the bearing seat, over in particular a rectilinear path that is longer than the roller positioning path, along the at least one linear guide and/or guided by the at least one linear guide. The bearing seat can then place the corresponding supply roller in a magazine and can permit a movement of the supply roller that is to be carried out by means of the magazine.

Alternatively or additionally, the application unit is preferably characterized in that the positioning device has at least one reservoir supporting member, and in that the at least one reservoir supporting member is movable, in particular linearly, specifically in and/or counter to the positioning direction and, in particular, both relative to the at least one main supporting member and relative to the at least one transfer supporting member, guided by the at least one linear guide and/or guided along the at least one linear guide. Alternatively or additionally, the application unit is preferably characterized in that an intermediate reservoir for application fluid is arranged on the at least one reservoir supporting member. Alternatively or additionally, the application unit is preferably characterized in that the reservoir supporting member is arranged at least partially between the at least one main supporting member and the at least one transfer supporting member, as viewed in the positioning direction. This enables the corresponding application fluid reservoir to be moved, at least without great additional effort, relative to the forme cylinder, in particular together with the supply roller, and if necessary, enables the supply roller to still be moved away along the same guide over a greater distance and thereby also distanced from the application fluid reservoir. This, in particular, enables a particularly simple changing of the supply roller.

Alternatively or additionally, the application unit is preferably characterized in that the at least one forme cylinder is configured as a flexographic forme cylinder, and/or in that the at least one supply roller is configured as an anilox roller, and/or in that the at least one intermediate reservoir is configured as a chamber doctor blade system, and/or in that the at least one forme cylinder is located below the at least one impression cylinder, and/or in that a magazine receptacle is understood as a defined spatial area that is intended to accommodate one supply roller.

Alternatively or additionally, the application unit is preferably characterized in that the at least one main supporting member is arranged guided by the same at least one linear guide as the at least one transfer supporting member, and/or in that the at least one main supporting member is arranged guided by the same at least one linear guide as the at least one reservoir supporting member, and/or in that the at least one reservoir supporting member is arranged guided by the same at least one linear guide as the at least one reservoir supporting member, and/or in that the at least one main supporting member and the at least one transfer supporting member and the at least one reservoir supporting member are arranged guided by the same at least one linear guide. All relevant movements are then possible with the simplest possible configuration of the device.

Alternatively or additionally, the application unit is preferably characterized in that the application unit has at least one main position adjustment device, by means of which the relative position of the at least one main supporting member relative to a frame of the application unit is determined, and in that the main position adjustment device comprises at least one main positioning drive. Alternatively or additionally, the application unit is preferably characterized in that the application unit has at least one transfer position adjustment device, by means of which a relative position of the at least one transfer supporting member relative to the at least one main supporting member of the application unit is determined, and in that the transfer position adjustment device comprises at least one transfer drive. Alternatively or additionally, the application unit is preferably characterized in that the at least one reservoir supporting member is arranged to be movable linearly relative to the main supporting member closest to it, and in that the at least one reservoir supporting member is connected to said main supporting member via a suspension mount. This suspension mount preferably permits a limited relative movement, oriented in and/or counter to the positioning direction, between the main supporting member, on the one hand, and the reservoir supporting member, on the other hand.

Alternatively or additionally, the application unit is preferably characterized in that the positioning device has at least one thrust stop, in particular adjustable, which is provided as a contact element for contact between the at least one transfer supporting member, on the one hand, and the at least one reservoir supporting member, on the other. In that case, no additional drive for movement of the reservoir supporting member needs to be provided.

The application unit has at least one magazine for storing supply rollers. The at least one magazine is located below the application mechanism. The magazine has at least two magazine receptacles, each for receiving one supply roller. The magazine further preferably has at least three and/or at least four magazine receptacles, each for receiving one supply roller, and/or a magazine receptacle is understood as a defined spatial area that is intended to receive one supply roller. The magazine has at least one movable repositioning device, by means of which the at least two magazine receptacles can be moved and can be placed in different magazine positions.

Alternatively or additionally, the application unit is preferably characterized in that the at least one supply roller can be moved by means of the at least one transfer supporting member along a roller positioning path that is exclusively linear, in particular. Alternatively or additionally, the application unit is preferably characterized in that by means of the at least one positioning device, the at least one supply roller can be moved along the linear, in particular exclusively linear, roller positioning path, one end of which is identical to a supply position and the other end of which is identical to one of the magazine positions. This first magazine position, in particular, is a change position, for example. The roller positioning path preferably extends in and/or counter to the positioning direction. When a magazine receptacle is located in the change position, a supply roller can be transferred, in or counter to a positioning direction, between said magazine receptacle, on the one hand, and a region of the roller positioning path that is remote from said magazine, on the other hand, said positioning path connecting the magazine to the application mechanism. This feature, in particular, preferably results in a particularly simple and/or rapid roller positioning path and/or a particularly simple device that is less prone to error.

At least one, in particular the second, of the magazine positions is a loading position. When a magazine receptacle is arranged in the loading position, a supply roller can be transferred along a linear loading path, in particular, in and/or counter to a loading direction, between said magazine receptacle, on the one hand, and a loading area, in particular of the application unit, on the other hand. The loading direction deviates no more than 30° from at least one horizontal direction. Alternatively or additionally, the application unit is preferably characterized in that the loading direction deviates no more than 30° and/or no more than 20° and/or no more than 10° and/or no more than 5° from at least one horizontal direction, or is oriented horizontally. This enables a simple feeding and removal of supply rollers to/from the application unit.

Alternatively or additionally, the application unit is preferably characterized in that magazine receptacles, in particular those magazine receptacles that are operatively connected to the repositioning device, are at least also defined by at least one respective inner boundary surface, which particularly is movable relative to a frame of the application unit and is intended for contact with a roller journal or a roller barrel of a respective supply roller. The at least one inner boundary surface is preferably a surface of the repositioning device.

Alternatively or additionally, the application unit is preferably characterized in that those magazine receptacles that are arranged in a magazine position of a first subset of all possible magazine positions are additionally defined at least also by at least one respective outer boundary surface, which in particular is arranged stationary relative to a frame of the application unit and is configured for contact with a roller journal or a roller barrel of a respective supply roller. The repositioning device and the inner boundary surface are preferably arranged to be movable relative to the outer boundary surface. In this way, safe handling of the supply rollers in the magazine can be achieved with a minimum expenditure on apparatus.

Alternatively or additionally, the application unit is preferably characterized in that the magazine has at least one outer boundary member, which is arranged stationary, in particular relative to the frame of the application unit, and in that the at least one outer boundary surface is a surface of the at least one outer boundary member. Alternatively or additionally, the application unit is preferably characterized in that the at least one repositioning device is arranged to be pivotable and/or rotatable about a stationary magazine axis, in particular, and/or in that the at least one repositioning device has at least two recesses that form magazine receptacles.

Alternatively or additionally, the application unit is preferably characterized in that the at least two recesses are each open in a radial direction relative to the magazine axis, and/or in that the at least one outer boundary surface is shaped such that its projection in the transverse direction corresponds to a circular arc. A central angle of this circular arc preferably measures at least 180°. This enables the simplest possible configuration of the magazine.

Alternatively or additionally, the application unit is preferably characterized in that the radius of this circular arc is greater than the greatest distance of the repositioning device from the magazine axis, and/or in that the radius of this circular arc is no more than 20% and/or no more than 10% and/or no more than 5% greater than the greatest distance of the repositioning device from the magazine axis.

BRIEF DESCRIPTION OF THE DRAWINGS

Exemplary embodiments of the invention are illustrated in the set of drawings and will be described in greater detail in the following.

The drawings show.

DESCRIPTION OF PREFERRED EMBODIMENTS

Figure 1:
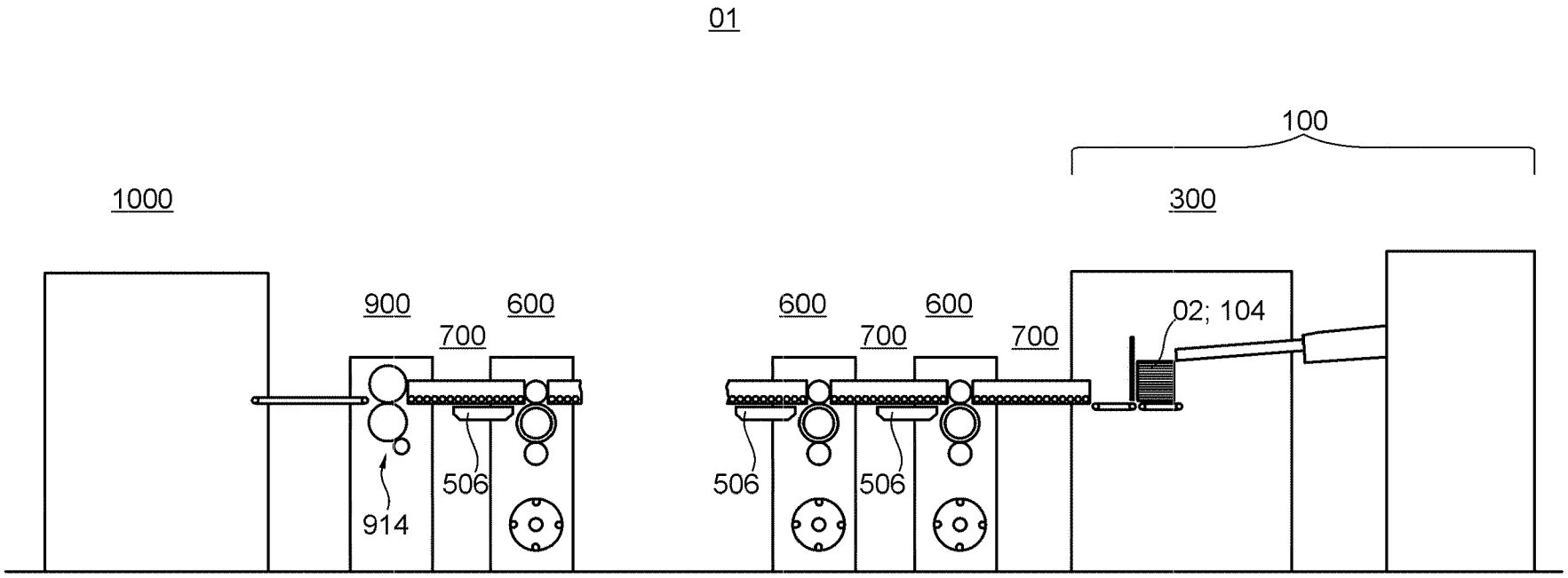
FIG. 1 a schematic representation of an example of a processing machine with multiple flexographic application mechanisms, of which three are shown, although any number is possible.

In the foregoing and in the following, the term coating medium or printing fluid or application fluid refers to inks and printing inks, but also to primers, varnishes, and pasty materials. Printing fluids are preferably materials that are and/or can be transferred by means of a processing machine 01, in particular a printing press 01, or by means of at least one application mechanism 414; 614; 814 or application unit 400; 600; 800 of the processing machine 01, in particular at least one printing mechanism 614 or printing unit 600 of the printing press 01, onto a substrate 02, in particular a printing material 02, thereby creating a preferably visible and/or perceptible and/or machine detectable texture, preferably in finely structured form and/or not merely over a large surface area, on the substrate 02, in particular printing material 02. Inks and printing inks are preferably solutions or dispersions of at least one colorant in at least one solvent. Suitable solvents include water and/or organic solvents, for example. Alternatively or additionally, the printing fluid can be embodied as printing fluid that is cured under UV light. Inks are relatively low-viscosity printing fluids and printing inks are relatively high-viscosity printing fluids. Inks preferably contain no binding agent or relatively little binding agent, whereas printing inks preferably contain a relatively large amount of binding agent, and more preferably contain additional auxiliary substances. Colorants may be pigments and/or dyes, with pigments being insoluble in the application medium, whereas dyes are soluble in the application medium.

In the interest of simplicity, in the foregoing and in the following—unless otherwise explicitly distinguished and specified—the term "printing ink" is understood to refer to a liquid or at least flowable fluid colorant to be used for printing in the printing press, and is not limited merely to the higher viscosity fluid colorants more frequently associated colloquially with the expression "printing ink" for use in rotary printing presses, but in addition to these higher viscosity fluid colorants particularly also includes lower viscosity fluid colorants such as "inks", in particular inkjet inks, but also powdered fluid colorants, such as toners, for example. Thus in the foregoing and in the following, when printing fluids and/or inks and/or printing inks are mentioned, this also includes colorless varnishes. In the foregoing and in the following, when printing fluids and/or inks and/or printing inks are mentioned, this also preferably includes, in particular, agents for pretreating (priming or pre-coating) the printing material 02. The term coating medium and the term application fluid may be understood as synonymous with the term printing fluid.

An application fluid preferably is not gaseous. An application fluid is preferably liquid and/or powdered.

A processing machine 01 is preferably configured as a printing press 01 and/or as a shaping machine 01, in particular a die-cutting machine 01. The printing press 01 is configured as a flexographic printing press 01, for example.

The processing machine 01 is preferably referred to as a printing press 01 if it comprises at least one printing mechanism 614 and/or at least one printing unit 600, in particular regardless of whether it comprises additional units for processing substrate 02. A processing machine 01 configured as a printing press 01 also comprises, for example, at least one additional such unit 400; 800; 900, for example at least one shaping unit 900, which is preferably configured as a die-cutting unit 900. The processing machine 01 is preferably referred to as a shaping machine 01 if it comprises at least one shaping mechanism 914 and/or at least one shaping unit 900, in particular regardless of whether it comprises additional units 400; 600; 800 for processing substrate 02. The processing machine 01 is preferably referred to as a die-cutting machine 01 if it comprises at least one die-cutting mechanism 914 and/or at least one die-cutting unit 900, in particular regardless of whether it comprises additional units 400; 600; 800 for processing substrate 02. A processing machine 01 configured as a shaping machine 01 or die-cutting machine 01 also comprises, for example, at least one additional unit 400; 600; 800 for processing substrate 02, for example at least one printing unit 600 and/or at least one printing mechanism 614. Thus, if the processing machine 01 comprises at least one printing mechanism 614 and/or at least one printing unit 600 and also comprises at least one shaping mechanism 914 and/or at least one shaping unit 900, it is configured both as a printing press 01 and as a shaping machine 01. If the processing machine 01 comprises at least one printing mechanism 614 and/or at least one printing unit 600 and also comprises at least one die-cutting mechanism 614 and/or at least one die-cutting unit 900, it is therefore configured both as a printing press 01 and as a shaping machine 01, in particular a die-cutting machine 01.

The processing machine 01 is preferably configured as a sheet processing machine 01, i.e. as a processing machine 01 for processing sheet-format substrate 02 or sheets 02, in particular a sheet-format printing material 02. For example, the sheet processing machine 01 is configured as a sheet-fed printing press 01 and/or as a sheet-fed shaping machine 01 and/or as a sheet-fed die-cutting machine 01. The processing machine 01 is further preferably configured as a corrugated cardboard sheet processing machine 01, i.e. as a processing machine 01 for processing sheet-format substrate 02 or sheets 02 of corrugated cardboard, in particular sheet-format printing substrate 02 made of corrugated cardboard. More preferably, the processing machine 01 is configured as a sheet-fed printing press 01, in particular as a corrugated cardboard sheet-fed printing press 01, i.e. as a printing press 01 for coating and/or printing sheet-format substrate 02 or sheets 02 of corrugated cardboard, in particular sheet-format printing material 02 made of corrugated cardboard. For example, printing press 01 is configured as a printing press 01 that operates according to a non-impact printing method and/or as a printing press 01 that operates according to a printing method that requires printing formes. Preferably, printing press 01 is configured as a non-impact printing press 01, in particular as an inkjet printing press 01 and/or as a flexographic printing press 01. Alternatively or additionally, the processing machine 01 may be configured as a web-fed processing machine 01, in particular a web-fed printing press 01, provided no contradictions arise as a result.

Unless an explicit distinction is made, the term sheet-format substrate 02, in particular printing material 02, specifically sheet 02, generally includes any flat substrate 02 in the form of sections, i.e. including substrates 02 in tabular form or panel form, i.e. including boards or panels. The sheet-format substrate 02 or sheet 02 thus defined is formed, for example, from paper or paperboard, i.e. as sheets of paper or paperboard, or as sheets 02, boards, or optionally panels made of plastic, cardboard, glass, or metal. The substrate 02 is more preferably corrugated cardboard 02, in particular corrugated cardboard sheets 02. The thickness of a sheet 02 is preferably understood as the dimension orthogonally to the largest surface area of the sheet 02. This largest surface area is also referred to as the main surface area. The thickness of the sheets 02 is, for example, at least 0.1 mm, more preferably at least 0.3 mm, and even more preferably at least 0.5 mm. For sheets of corrugated cardboard 02, in particular, significantly greater thicknesses are also common, for example at least 4 mm or even 10 mm or more. Corrugated cardboard sheets 02 are relatively stable and therefore are not very flexible. Corresponding adjustments to the processing machine 01 therefore facilitate the processing of sheets 02 of great thickness.

The processing machine 01 preferably comprises multiple units 100; 200; 300; 400; 600; 700; 800; 900; 1000. Each unit 100; 200; 300; 400; 600; 700; 800; 900; 1000 is preferably understood as a group of systems that function in cooperation, in particular to carry out a preferably self-contained step in the processing of sheets 02. For example, at least two and preferably at least three, and more preferably all of the units 100; 200; 300; 400; 600; 700; 800; 900; 1000 are configured as modules 100; 200; 300; 400; 600; 700; 800; 900; 1000 or are at least each associated with such a module. A module 100; 200; 300; 400; 600; 700; 800; 900; 1000 in this context is understood in particular as a respective unit or a structure made up of multiple units, which preferably has at least one transport means and/or at least its own controllable and/or regulatable drive, and/or is preferably configured as an independently functioning module and/or as an individually manufactured and/or separately assembled machine unit or functional assembly. A separately controllable and/or regulatable drive of a unit or module is understood in particular as a drive that is used to drive the movements of components of said unit or module and/or that is used to transport substrate 02, in particular sheets 02, through said respective unit or module and/or through at least one processing zone of said respective unit or module and/or that is used to directly or indirectly drive at least one component of the respective unit or module that is intended for contact with sheets 02. Said drives of the units of the processing machine 01 are preferably embodied, in particular, as closed loop position-controlled electric motors.

Each unit 100; 200; 300; 400; 600; 700; 800; 900; 1000 preferably has at least one drive control system and/or at least one drive controller, which is assigned to the respective at least one drive of the respective unit. The drive control systems and/or drive controllers of the individual units 100; 200; 300; 400; 600; 700; 800; 900; 1000 can preferably be operated individually and independently of one another. Further preferably, the drive control systems and/or drive controllers of the individual units 100; 200; 300; 400; 600; 700; 800; 900; 1000 are and/or can be linked in terms of circuitry, in particular by means of at least one BUS system, to one another and/or to a machine control system of the processing machine 01 in such a way that a coordinated control and/or regulation of the drives of multiple or of all units 100; 200; 300; 400; 600; 700; 800; 900; 1000 of the processing machine 01 is and/or can be carried out. The individual units and/or particularly modules of the processing machine 01 therefore are and/or can be operated preferably electronically synchronized with one another, at least with respect to their drives, in particular by means of at least one electronic master axis. For this purpose, an electronic master axis is preferably specified, for example by a higher-level machine control system of the processing machine 01. To generate the electronic master axis, the higher-level machine control system uses components of a specific control system and/or a specific controller of a specific unit. Preferably multiple, or more preferably all of the units are configured such that they can be used as a leading unit, which the remaining units follow and/or are capable of following during operation of the processing machine 01. Alternatively or additionally, the individual units of the processing machine 01 are and/or can be synchronized with one another mechanically, for example, at least with respect to their drives. Preferably, however, the individual units of the processing machine 01 are decoupled from one another mechanically, at least with respect to their drives.

Unless otherwise described, each of the units of the processing machine 01 is preferably characterized in that the section of the transport path provided for sheets 02, which is defined by the respective unit, extends at least substantially flat and more preferably completely flat. A substantially flat section of a transport path provided for sheets 02 is understood as a section that has a minimum radius of curvature of at least 2 meters, more preferably at least 5 meters, even more preferably at least 10 meters, and more preferably still at least 50 meters. A completely flat section has an infinitely large radius of curvature and is thus likewise substantially flat and therefore likewise has a minimum radius of curvature of at least 2 meters. Unless otherwise described, each of the units of the processing machine 01 is preferably characterized in that the section of the transport path provided for sheets 02, which is defined by the respective unit, extends at least substantially horizontally and more preferably exclusively horizontally. Said transport path preferably extends in a direction of transport T. A substantially horizontal transport path provided for sheets 02 means, in particular, that within the entire area of the respective unit, the provided transport path has only one or has multiple directions that deviate no more than 30°, preferably no more than 15°, and more preferably no more than 5° from at least one horizontal direction. The direction of the transport path is, in particular, the direction in which the sheets 02 are transported at the point at which the direction is measured. The transport path provided for sheets 02 preferably begins at a point at which the sheets 02 are removed from a feeder pile 104.

The processing machine 01 preferably has at least one substrate supply device 100, which more preferably is configured as a unit 100, in particular a substrate supply unit 100, and/or as a module 100, in particular a substrate supply module 100. In the case of a sheet processing machine 01, in particular, the at least one substrate supply device 100 is preferably configured as a sheet feeder 100 and/or sheet feeder unit 100 and/or sheet feeder module 100.

The processing machine 01 has, for example, at least one unit 200 configured as a conditioning device 200, in particular a conditioning unit 200, which is more preferably configured as a module 200, in particular as a conditioning module 200. Such a conditioning device 200 is configured, for example, as a pre-processing device 200 or as a post-processing device. The processing machine 01 preferably has at least one unit 200 configured as a pre-processing device 200, in particular as a pre-processing unit 200, which is further preferably configured as a module 200, in particular as a pre-processing module 200, and which is a conditioning device 200. The processing machine 01 preferably has at least one post-processing device.

The processing machine 01 preferably has at least one infeed device 300. The at least one infeed device 300 is, for example, at least one unit 300 configured as an infeed device 300, in particular an infeed unit 300, which is further preferably configured as a module 300, in particular as an infeed module 300. Alternatively, the at least one infeed device 300 is configured as a component of the substrate supply device 100 or of another unit.

The processing machine 01 preferably has at least one application unit 400; 600; 800, which is further preferably configured as a module 400; 600; 800, in particular application module 400; 600; 800. The at least one application unit 400; 600; 800 is positioned and/or structured based on its function and/or its application method. The at least one application unit 400; 600; 800 preferably serves to apply at least one respective application fluid or coating medium over the entire surface area and/or a portion of the surface area of the sheets 02. One example of an application unit 400; 600; 800 is a priming unit 400, which is used in particular for applying a primer to substrate 02, in particular sheets 02. Another example of an application unit 400; 600; 800 is a printing unit 600, which serves in particular to apply printing ink and/or ink to substrate, in particular sheets 02. A further example of an application unit 400; 600; 800 is a varnishing unit 800, which serves in particular to apply varnish to substrate 02, in particular sheets 02.

Independently, in particular, of the function of the application fluid that can be applied by the application units 400; 600; 800, said units can preferably be distinguished in terms of their application method. One example of an application unit 400; 600; 800 is a forme-based application unit 400; 600; 800, which has, in particular, at least one fixed, physical, and preferably replaceable printing forme. Forme-based application units 400; 600; 800 preferably operate according to a planographic printing method, in particular an offset planographic printing method, and/or according to a gravure printing method, and/or according to a letterpress printing method, particularly preferably according to a flexographic printing method. In that case, the corresponding application unit 400; 600; 800 is a flexographic application unit 400; 600; 800, for example, in particular a flexographic application module 400; 600; 800. Another example of an application unit 400; 600; 800 is a printing forme-free or non-impact application unit 400; 600; 800, in particular a printing forme-free or non-impact application module 400; 600; 800, which operates in particular without a fixed printing forme. Printing forme-free or non-impact printing units 400; 600; 800 operate, for example, according to an ionographic method and/or a magnetographic method and/or a thermographic method and/or electrophotography and/or laser printing and/or particularly preferably according to an inkjet printing method. In that case, the application unit 400; 600; 800 is accordingly an inkjet application unit 400; 600; 800, for example, in particular an inkjet application module 400; 600; 800.

Each application unit 400; 600; 800 preferably has at least one respective application mechanism 414; 614; 814. A respective application unit 400; 600; 800 also has, for example, at least one drive M1; M2; M3; M4; M6; M7 and/or at least one frame 427; 627; 827 and/or at least one further component.

An application unit 400; 600; 800 is also understood, in particular, as such a unit 400; 600; 800 that is also suitable at least for applying a primer. If such an application unit 400 is intended to apply primer, it is also referred to as a priming unit 400. An application mechanism 414; 614; 814 is also understood, in particular, as such an application mechanism 414; 614; 814 that is also suitable at least for applying primer. If such an application mechanism 414 is intended to apply primer, it is also referred to as a priming mechanism 414. Each priming unit 400 preferably has at least one respective priming mechanism 414. The processing machine 01 preferably has at least one unit 400 configured as a priming device 400, in particular priming unit 400, which is further preferably configured as module 400, in particular as priming module 400.

An application unit 400; 600; 800 is also understood, in particular, as such a unit 400; 600; 800 that is also suitable at least for applying printing ink. If such an application unit 600 is intended to apply printing ink, it is also referred to as a printing unit 600. An application mechanism 414; 614; 814 is also understood, in particular, as such an application mechanism 414; 614; 814 that is also suitable at least for applying printing ink. If such an application mechanism 614 is intended to apply printing ink, it is also referred to as a printing mechanism 614. Each printing unit 600 preferably has at least one respective printing mechanism 614. The processing machine 01 preferably has at least one unit 600 configured as a printing unit 600, which is further preferably configured as a module 600, in particular as a printing module 600.

An application unit 400; 600; 800 is also understood, in particular, as such a unit 400; 600; 800 that is also suitable at least for applying varnish. If such an application unit 800 is intended to apply varnish, it is also referred to as a varnishing unit 800. An application mechanism 414; 614; 814 is also understood, in particular, as such an application mechanism 414; 614; 814 that is also suitable at least for applying varnish. If such an application unit 814 is intended to apply varnish, it is also referred to as a varnishing mechanism 814. Each varnishing unit 800 preferably has at least one respective varnishing mechanism 814. The processing machine 01 preferably has at least one unit 800 configured as a varnishing device 800, in particular varnishing unit 800, which is further preferably configured as a module 800, in particular as a varnishing module 800.

At least one application unit 400; 600; 800 of the processing machine 01 is configured as a flexographic application unit 400; 600; 800, for example. Alternatively or additionally, at least one application unit 400; 600; 800 of the processing machine 01 is configured as a non-impact application unit 400; 600; 800, in particular an inkjet application unit 400; 600; 800. At least one printing unit 600 of printing press 01 is configured as a flexographic printing unit 600, for example. Alternatively or additionally, at least one printing unit 600 of the printing press 01 is configured as a non-impact printing unit 600, in particular an inkjet printing unit 600. Alternatively or additionally, at least one priming unit 400 of the processing machine 01 is configured as a flexographic priming unit 400, for example. Alternatively or additionally, at least one priming unit 400 of the printing press 01 is configured as a non-impact priming unit 400, in particular an inkjet priming unit 400. Alternatively or additionally, at least one varnishing unit 800 of the processing machine 01 is configured as a flexographic varnishing unit 800, for example. Alternatively or additionally, at least one varnishing unit 800 of the printing press 01 is configured as a non-impact varnishing unit 800, in particular an inkjet varnishing unit 800.

At least one application mechanism 414; 614; 814 of the processing machine 01 is configured as a flexographic application mechanism 414; 614; 814, for example. Alternatively or additionally, at least one application mechanism 414; 614; 814 of the processing machine 01 is configured as a non-impact application mechanism 414; 614; 814, in particular an inkjet application mechanism 414; 614; 814. At least one printing mechanism 614 of the printing press 01 is configured as a flexographic printing mechanism 614, for example. Alternatively or additionally, at least one printing mechanism 614 of the printing press 01 is configured as a non-impact printing mechanism 614, in particular an inkjet printing mechanism 614. Alternatively or additionally, at least one priming mechanism 414 of the printing press 01 is configured as a flexographic priming mechanism 414, for example. Alternatively or additionally, at least one priming mechanism 414 of the printing press 01 is configured as a non-impact priming mechanism 414, in particular an inkjet priming mechanism 414. Alternatively or additionally, at least one varnishing mechanism 814 of the printing press 01 is configured as a flexographic varnishing mechanism 814, for example. Alternatively or additionally, at least one varnishing mechanism 814 of the printing press 01 is configured as a non-impact varnishing mechanism 814, in particular as an inkjet varnishing mechanism 814.

The processing machine 01 has, for example, at least one unit configured as a drying device, in particular a drying unit, which is more preferably configured as a module, in particular as a drying module. Alternatively or additionally, at least one drying device 506 and/or at least one after-drying device 507, for example, is a component of at least one unit 100; 200; 300; 400; 600; 700; 800; 900; 1000 preferably configured as a module 100; 200; 300; 400; 600; 700; 800; 900; 1000. For example, at least one application unit 400; 600; 800 has at least one drying device 506 and/or at least one after-drying device 507, and/or at least one transport device 700 and/or at least one transport unit 700 has at least one drying device 506 and/or at least one after-drying device 507.

The processing machine 01 preferably has at least one unit 700 configured as a transport device 700 or transport means 700, in particular transport unit 700, which is further preferably configured as a module 700, in particular as a transport module 700. Additionally or alternatively, the processing machine 01 preferably has transport devices 700 as components of other units and/or modules, for example.

The processing machine 01 preferably has at least one unit 900 configured as a shaping device 900, in particular a shaping unit 900, which is more preferably configured as a module 900, in particular as a shaping module 900. The processing machine 01 preferably has at least one shaping unit 900 configured as a die-cutting unit 900. The at least one shaping device 900 is preferably configured as a rotary die cutter 900.

The processing machine 01 preferably has at least one unit 1000 configured as a substrate output device 1000, in particular configured as a sheet delivery 1000, in particular a delivery unit 1000, which is more preferably configured as a module 1000, in particular as a delivery module 1000.

The processing machine 01 has, for example, at least one unit configured as a post-press processing device, in particular a post-press processing unit, which is more preferably configured as a module, in particular as a post-press processing module.

The direction of transport T provided in particular for the transport of sheets 02 is a direction T that is oriented preferably at least substantially and more preferably completely horizontally and/or that preferably points from a first unit of the processing machine 01 toward a last unit of the processing machine 01, in particular from a sheet feeder unit 100 or a substrate supply device 100 on the one hand toward a delivery unit 1000 or a substrate output device 1000 on the other hand, and/or that preferably points in a direction in which the sheets 02 are transported, apart from vertical movements or vertical components of movements, in particular from a first point of contact with a unit of the processing machine 01 that is situated downstream of the substrate supply device 100 or a first point of contact with the processing machine 01 up to a last point of contact with the processing machine 01. Regardless of whether the infeed device 300 is an independent unit 300 or module 300 or is a component of the substrate supply device 100, the direction of transport T is preferably the direction T in which the direction of a horizontal component is oriented from the infeed device 300 toward the substrate output device 1000.

A transverse direction A is preferably a direction that is oriented orthogonally to the direction of transport T of the sheets 02 and/or orthogonally to the intended transport path of the sheets 02 through the at least one application unit 400; 600; 800. The transverse direction A is preferably a horizontally oriented direction A. A working width of the processing machine 01 and/or the at least one application unit 400; 600; 800 is preferably a dimension that extends preferably orthogonally to the intended transport path of the sheets 02 through the at least one application unit 400; 600; 800, more preferably in a transverse direction A. The working width of the processing machine 01 preferably corresponds to the maximum width a sheet 02 may have in order to still be processable by the processing machine 01, i.e. in particular a maximum sheet width that can be processed by the printing press 01. In this context, the width of a sheet 02 is understood in particular as its dimension in the transverse direction A. This is preferably independent of whether this width of the sheet 02 is greater than or less than a horizontal dimension of the sheet 02, orthogonally thereto, which more preferably represents the length of said sheet 02. The working width of the processing machine 01 is preferably equal to the working width of the at least one application unit 400; 600; 800. The transverse direction A is preferably oriented parallel to an axis of rotation 39 of a forme cylinder 402; 602; 802 of an application unit 400; 600; 800. The working width of the processing machine 01, in particular sheet processing machine 01, is preferably at least 100 cm, more preferably at least 150 cm, even more preferably at least 160 cm, even more preferably at least 200 cm, and more preferably still at least 250 cm.

The processing machine 01 preferably has at least one flexographic application mechanism 414; 614; 814. At least one application unit 400; 600; 800 is preferably configured as a flexographic application unit 400; 600; 800. More preferably, at least one printing unit 600 is configured as a flexographic printing unit 600 and/or at least one priming unit 400 is configured as a flexographic priming unit 400 and/or at least one varnishing unit 800 is configured as a flexographic varnishing unit 800. The at least one flexographic application unit 400; 600; 800 preferably has at least one flexographic application mechanism 414; 614; 814, which is more preferably configured as a flexographic priming mechanism 414 and/or as a flexographic printing mechanism 614 and/or as a flexographic varnishing mechanism 814.

The at least one flexographic application mechanism 414; 614; 814 preferably has at least one application cylinder 402; 602; 802, which serves to apply application fluid to substrate 02, in particular sheets 02, and is intended in particular for contact with substrate 02, in particular sheets 02. The application cylinder 402; 602; 802 is preferably configured as a forme cylinder 402; 602; 802, for example known as a plate cylinder 402; 602; 802. The forme cylinder 402; 602; 802 has a cylinder barrel 12 and two cylinder journals 13, arranged at its two axial ends. Rolling bearings 26 are preferably arranged on the cylinder journals 13 of the forme cylinder 402; 602; 802, in particular for the rotatable mounting of said cylinder. On the forme cylinder 402; 602; 802, in particular on the cylinder barrel 12 thereof, at least one packing 04, in particular removable, in the form of at least one removable application forme 04, in particular priming forme 04 or printing forme 04 or varnishing forme 04, preferably is and/or can be arranged. This packing 04 preferably serves to define the areas in which application fluid is to be transferred, and if applicable, in which application fluid will not be transferred. The respective packing 04 can serve, in particular, to provide substrate 02, in particular sheets 02, with application fluid over their entire surface. The respective packing 04 is and/or can be positioned, and preferably is and/or can be secured, preferably by means of at least one corresponding holding means, in particular a clamping device and/or tensioning device, on a circumferential surface of the application cylinder 402; 602; 802. At least one drive M2, referred to as forme cylinder drive M2, is preferably provided, by means of which the at least one application cylinder 402; 602; 802 can be turned and/or rotated about its axis of rotation 39. The at least one forme cylinder drive M2 is preferably embodied as a motor M2, more preferably as a closed loop position-controlled electric motor M2, in particular.

The at least one flexographic application mechanism 414; 614; 814 preferably has at least one impression cylinder 408; 608; 808. The impression cylinder 408; 608; 808 has a cylinder barrel 14 and two cylinder journals 16, arranged at its two axial ends. Rolling bearings are preferably arranged on the cylinder journals 16 of the impression cylinder 408; 608; 808, in particular for the rotatable mounting of said cylinder. The impression cylinder 408; 608; 808 is preferably intended to cooperate with the application cylinder 402; 602; 802 and/or to form an application nip 409; 609; 809. The respective application nip 409; 609; 809 is, in particular, the specific region in which the cylinder barrel 12 of the forme cylinder 402; 602; 802 and the cylinder barrel 14 of the impression cylinder 408; 608; 808 are closest to and/or touching one another. Such a respective application nip 409; 609; 809 is referred to, for example, as a priming nip 409 or as a printing nip 609 or as a varnishing nip 809. Substrate 02, in particular sheets 02, preferably pass through the at least one application nip 409; 609; 809 during operation of the processing machine 01, and at that time are at least temporarily in contact both with the application cylinder 402; 602; 802 on one side, in particular with the packing 04 arranged thereon, and with the impression cylinder 408; 608; 808 on their other side. At least one drive M1, referred to as the impression cylinder drive M1, is preferably provided, by means of which the at least one impression cylinder 408; 608; 808 can be turned and/or rotated about its axis of rotation 42. The at least one impression cylinder drive M1 is preferably embodied as a motor M1, more preferably as a closed loop position-controlled electric motor M1, in particular.

The at least one flexographic application mechanism 414; 614; 814 preferably has at least one supply roller 403; 603; 803, which is more preferably configured as an anilox roller 403; 603; 803 and/or which has a saucer structure on its circumferential surface, in particular on the circumferential surface of its roller barrel 17. The supply roller 403; 603; 803 has a roller barrel 17 and two roller journals 18 arranged at its two axial ends. Rolling bearings 27 are preferably arranged on the roller journals 18 of the supply roller 403; 603; 803, in particular for the rotatable mounting of said supply roller 403; 603; 803. The at least one supply roller 403; 603; 803 preferably is in contact with and/or can be brought into contact with the forme cylinder 402; 602; 802. At least one drive M3, referred to as the supply roller drive M3 or anilox roller drive M3, is preferably provided, by means of which the at least one supply roller 403; 603; 803 can be turned and/or rotated about its axis of rotation 41. The at least one supply roller drive M3 or anilox roller drive M3 is preferably embodied as a motor M3, more preferably as a closed loop position-controlled electric motor M3, in particular. The supply roller drive M3 preferably is and/or can be connected to the supply roller 403; 603; 803 via a releasable connection, for example by means of a coupling. This connection is preferably released in order to place the supply roller 403; 603; 803 in the magazine 21.

The at least one flexographic application mechanism 414; 614; 814 preferably has at least one application fluid reservoir 401; 601; 801, which is configured and/or can be used, for example, as a primer reservoir 401 and/or as a colorant reservoir 601 or as an ink reservoir 601 and/or as a varnish reservoir 801. At least one intermediate reservoir 404; 604; 804 for application fluid preferably is and/or can be arranged in contact with and/or in operative connection with the at least one supply roller 403; 603; 803. This at least one intermediate reservoir 404; 604; 804 is preferably configured as a chamber doctor blade system 404; 604; 804. Thus, at least one chamber doctor blade system 404; 604; 804 is preferably in contact and/or in operative connection with the supply roller 403; 603; 803, configured in particular as an anilox roller 403; 603; 803. The intermediate reservoir 404; 604; 804 preferably configured as a chamber doctor blade system 404; 604; 804 is preferably connected via at least one supply line 406; 606; 806, and more preferably also via at least one drain line 407; 607; 807, to the at least one application fluid reservoir 401; 601; 801. The supply line 406; 606; 806 and/or the drain line 407; 607; 807 is preferably in operative connection with at least one pump device.

A preferred first embodiment of the flexographic application mechanism 414; 614; 814 is intended to furnish substrate 02, in particular sheets 02 and/or printing material 02, with application fluid, for example to print it, from below. In this preferred first embodiment of the flexographic application mechanism 414; 614; 814, the forme cylinder 402; 602; 802 is preferably arranged below the impression cylinder 408; 608; 808, more preferably such that the axis of rotation 39 of the forme cylinder 402; 602; 802 is arranged below the cylinder barrel 14 of the impression cylinder 408; 608; 808 in the vertical direction V, and even more preferably such that the axis of rotation 39 of the forme cylinder 402; 602; 802 is arranged below the axis of rotation 42 of the impression cylinder 408; 608; 808 in the vertical direction V. In this first embodiment of the flexographic application mechanism 414; 614; 814, the supply roller 403; 603; 803 is preferably arranged below the forme cylinder 402; 602; 802, more preferably such that the axis of rotation 41 of the supply roller 403; 603; 803 is arranged below the cylinder barrel 12 of the forme cylinder 402; 602; 802 in the vertical direction V, and even more preferably such that the axis of rotation 41 of the supply roller 403; 603; 803 is arranged below the axis of rotation 39 of the forme cylinder 402; 602; 802 in the vertical direction V.

An alternative second embodiment of the flexographic application mechanism 414; 614; 814 is intended to furnish substrate 02, in particular sheets 02 and/or printing material 02, with application fluid, for example to print it, from above. In this second embodiment of the flexographic application mechanism 414; 614; 814, the forme cylinder 402; 602; 802 is preferably arranged above the impression cylinder 408; 608; 808, more preferably such that the axis of rotation 39 of the forme cylinder 402; 602; 802 is arranged above the cylinder barrel 14 of the impression cylinder 408; 608; 808 in the vertical direction V, and even more preferably such that the axis of rotation 39 of the forme cylinder 402; 602; 802 is arranged above the axis of rotation 42 of the impression cylinder 408; 608; 808 in the vertical direction V. In this second embodiment of the flexographic application mechanism 414; 614; 814, the supply roller 403; 603; 803 is preferably arranged above the forme cylinder 402; 602; 802, more preferably such that the axis of rotation 41 of the supply roller 403; 603; 803 is arranged above the cylinder barrel 12 of the forme cylinder 402; 602; 802 in the vertical direction V, and even more preferably such that the axis of rotation 41 of the supply roller 403; 603; 803 is arranged above an axis of rotation 39 of the forme cylinder 402; 602; 802 in the vertical direction V.

In the following, a flexographic application mechanism 414; 614; 814 according to the first embodiment of the flexographic application mechanism 414; 614; 814, which is intended to furnish substrate 02 with application fluid from below, will be described. Provided no contradictions arise, this description can also be applied, in particular analogously, to a flexographic application mechanism 414; 614; 814 according to the second embodiment of the flexographic application mechanism 414; 614; 814. In particular, the respective forme cylinder 402; 602; 802 is preferably similarly constructed regardless of whether it is arranged and/or will be used in a flexographic application mechanism 414; 614; 814 according to the first embodiment of the flexographic application mechanism 414; 614; 814 or in a flexographic application mechanism 414; 614; 814 according to the second embodiment of the flexographic application mechanism 414; 614; 814.

The application unit 400; 600; 800 preferably has at least one positioning device 43. The at least one positioning device 43 is preferably used to modify and/or adjust, particularly in a targeted manner, the arrangement of at least the forme cylinder 402; 602; 802, in particular the axis of rotation 39 thereof, and/or the at least one supply roller 403; 603; 803, in particular the axis of rotation 41 thereof, and/or the at least one application fluid reservoir 401; 601; 801 relative to one another and/or relative to a frame 427; 627; 827 of the application unit 400; 600; 800 and/or relative to the impression cylinder 408; 608; 808, in particular the axis of rotation 42 thereof. The application unit 400; 600; 800 may have two positioning devices 43, for example, a first positioning device 43 preferably being associated at least with a first cylinder journal 13 of the forme cylinder 402; 602; 802 and/or with a first cylinder journal 16 of the impression cylinder 408; 608; 808 and/or with a first roller journal 18 of the supply roller 403; 603; 803 and/or with a first side wall of the frame 427; 627; 827 of the application unit 400; 600; 800, and a second positioning device 43 preferably being associated at least with a second cylinder journal 13 of the forme cylinder 402; 602; 802 and/or with a second cylinder journal 16 of the impression cylinder 408; 608; 808 and/or with a second roller journal 18 of the supply roller 403; 603; 803 and/or with a second side wall of the frame 427; 627; 827 of the application unit 400; 600; 800. The first and second positioning devices 43 are preferably part of a positioning system and preferably share at least one component, for example at least one drive M4, in particular at least one main positioning drive M4.

The forme cylinder 402; 602; 802, on the one hand, and the impression cylinder 408; 608; 808, on the other hand, are preferably arranged to be movable relative to one another, in particular by means of the at least one positioning device 43. In this way, a corresponding application nip 409; 609; 809 can preferably be adapted to different thicknesses of substrate 02 to be processed. In addition, maintenance operations, such as the changing of a packing 04, can be facilitated. In particular, the axis of rotation 39 of the forme cylinder 402; 602; 802, on the one hand, and the axis of rotation 42 of the impression cylinder 408; 608; 808, on the other hand, are preferably arranged to be movable relative to one another. In a preferred embodiment, the axis of rotation 42 of the impression cylinder 408; 608; 808 is stationary, in particular stationary relative to the frame 427; 627; 827 of the flexographic application mechanism 414; 614; 814 and/or the frame of the flexographic application unit 400; 600; 800. The axis of rotation 39 of the forme cylinder 402; 602; 802 is preferably arranged to be movable, in particular linearly movable, further preferably in and/or counter to a positioning direction B or main positioning direction B, in particular relative to the frame 427; 627; 827 of the flexographic application mechanism 414; 614; 814 and/or the flexographic application unit 400; 600; 800. The positioning direction B is preferably oriented orthogonally to the transverse direction A. The positioning direction B preferably deviates no more than 45°, more preferably no more than 30°, even more preferably no more than 20°, even more preferably no more than 10°, more preferably still no more than 5° from a vertical direction V, and is even more preferably oriented parallel to the vertical direction V.

The flexographic application mechanism 414; 614; 814 preferably has at least one supporting member 06 that is associated with the forme cylinder 402; 602; 802 and is also referred to as a forme cylinder supporting member 06 and/or main supporting member 06 and/or positioning supporting member 06. This supporting member 06 may be configured as a single integral part, for example. Preferably, however, this supporting member 06 is configured as a multipart assembly 06. The flexographic application mechanism 414; 614; 814 further preferably has at least two such supporting members 06 associated with the forme cylinder 402; 602; 802, one being associated with each of the two cylinder journals 13 of the forme cylinder 402; 602; 802. The forme cylinder 402; 602; 802 is preferably connected at each of its cylinder journals 13 to the respective main supporting member 06, in each case via at least one rolling bearing 26 that preferably rotatably supports the forme cylinder 402; 602; 802. For this purpose, at least one bearing seat is preferably provided, which is more preferably at least partially connected and even more preferably fully connected to the respective main supporting member 06, and which accommodates or is capable of accommodating the respective rolling bearing 26 of the forme cylinder 402; 602; 802.

The at least one main supporting member 06 is preferably arranged to be movable, in particular linearly movable, relative to the frame 427; 627; 827 of the application unit 400; 600; 800 or the flexographic application mechanism 414; 614; 814. The main supporting member 06 and/or the forme cylinder 402; 602; 802 is preferably arranged to be movable relative to the frame 427; 627; 827 of the flexographic application mechanism 414; 614; 814 in and/or counter to the positioning direction B, which is preferably also referred to as the positioning direction B of the flexographic application mechanism 414; 614; 814.

At least one main guide 07, more preferably configured as a linear guide 07, is preferably provided. Preferably, the at least one main supporting member 06 is arranged to be movable, guided by the at least one main guide 07. The at least one main guide 07 preferably comprises at least one first guide rail 07, more preferably at least one first guide rail 07 per main supporting member 06, and even more preferably two first guide rails 07 per main supporting member 06. The at least one first guide rail 07 is preferably configured as a first linear guide rail 07. The at least one main supporting member 06 is preferably a component of the at least one positioning device 43. The at least one first main guide 07 is preferably a component of the at least one positioning device 43. The respective positioning device 43 preferably has a main supporting member 06 and/or at least one first guide rail 07, in particular two first guide rails 07. Thus, the forme cylinder 402; 602; 802 is preferably mounted on its two cylinder journals 13 via rolling bearings 26, each in a main supporting member 06, which is arranged such that it can be moved and/or positioned along at least one, in particular at least two guide rails 07.

At least one drive M4, referred to as positioning drive M4 or main positioning drive M4, is preferably provided. The at least one positioning drive M4 is preferably used to adjust and/or to modify and/or optionally to hold a position of the at least one and preferably the two main supporting members 06 relative to the frame 427; 627; 827 of the flexographic application mechanism 414; 614; 814 and/or along the at least one main guide 07. The at least one main supporting member 06 is preferably arranged to be movable in and/or counter to the positioning direction B, in particular by means of the first positioning drive M4 and/or relative to the frame 427; 627; 827 of the flexographic application mechanism 414; 614; 814. The at least one forme cylinder 402; 602; 802 is preferably arranged to be movable in and/or counter to the positioning direction B, in particular by means of the first positioning drive M4 and/or relative to the frame 427; 627; 827 of the flexographic application mechanism 414; 614; 814. The at least one first positioning drive M4 is preferably a component of the at least one positioning device 43 and more preferably is a component of both positioning devices 43.

The at least one positioning drive M4 is preferably configured as a motor M4, more preferably as an electric motor M4, and even more preferably as a closed loop position-controlled electric motor M4. At least one main gearbox 08 of the flexographic application mechanism 414; 614; 814 is preferably provided. The at least one main gearbox 08 preferably serves to convert a respective movement of the positioning drive M4 into a movement of the main supporting member 06, in particular in and/or counter to the positioning direction B. The at least one main gearbox 08 is preferably a component of the at least one positioning device 43. The at least one main gearbox 08 preferably has at least one main threaded rod 09. The main threaded rod 09 is preferably mounted to be rotatable, in particular rotatable by means of the positioning drive M4. At least one main mating thread, which cooperates with the thread of the main threaded rod 09, is preferably arranged on the at least one main supporting member 06, in particular immovably relative to the main supporting member 06 at least during a positioning operation. The rotation of the at least one main threaded rod 09 then moves this main mating thread along the main threaded rod 09, thereby moving the at least one main supporting member 06 along the main threaded rod 09. The thread axis of the main threaded rod 09 is preferably oriented parallel to the positioning direction B.

At least two such main threaded rods 09 are preferably provided. Two main supporting members 06 are preferably arranged as described. Preferably at least one, and more preferably precisely one, of the two main threaded rods 09 cooperates as described with each of the two main supporting members 06. At least one torque transmitter 11 is preferably provided, in particular as a component of the at least one main gearbox 08. The at least one torque transmitter 11 preferably is arranged such that it can be driven directly or indirectly by the positioning drive M4 and/or is configured as a shaft 11. The at least one first torque transmitter 11 is preferably connected to the at least two main threaded rods 09 such that it transmits or is capable of transmitting torque, in particular such that when the torque transmitter 11 rotates, the two main threaded rods 09 are rotated synchronously about their thread axes. In this way, the two main supporting members 06 and/or the two cylinder journals 13 of the forme cylinder 402; 602; 802 can be moved simultaneously and uniformly in and/or counter to the positioning direction B by means of the positioning drive M4.

Alternatively or additionally, the application unit 400; 600; 800 is preferably characterized in that the application unit 400; 600; 800 has at least one main position adjustment device, by means of which the relative position of the at least one main supporting member 06 relative to a frame 427; 627; 827 of the application unit 400; 600; 800 is determined, and in that the main position adjustment device comprises at least one main positioning drive M4. The main position adjustment device preferably comprises the at least one main gearbox 08 and/or the at least one main threaded rod 09 and/or the at least one main mating thread and/or the at least one main positioning drive M4. In place of the described main gearbox 08 and/or positioning drive M4 and/or main mating thread, the at least one main position adjustment device can alternatively have at least one other drive concept, for example at least one pneumatic and/or hydraulic linear drive, with or without stops for specific positions.

The supply roller 403, 603, 803, on the one hand, and the forme cylinder 402; 602; 802, on the other hand, are preferably arranged movably relative to one another. In this way, a corresponding application nip 409; 609; 809 can preferably be adapted to different thicknesses of substrate 02 to be processed. In addition, maintenance work, such as changing a packing 04 and/or cleaning a supply roller 403, 603, 803 and/or installing and/or replacing and/or removing a supply roller 403, 603, 803, can be facilitated. In particular, the axis of rotation 41 of the supply roller 403, 603, 803, on the one hand, and the axis of rotation 39 of the forme cylinder 402; 602; 802, on the other hand, are preferably arranged to be movable relative to one another, more preferably are arranged to be movable at least linearly relative to one another, even more preferably in and/or counter to the positioning direction B. Preferably, the axis of rotation 41 of the supply roller 403, 603, 803 is arranged to be movable, in particular linearly movable, more preferably in and/or counter to the positioning direction B, in particular relative to the frame 427; 627; 827 of the flexographic application mechanism 414; 614; 814 and/or the flexographic application unit 400; 600; 800.

The flexographic application mechanism 414; 614; 814 preferably has at least one supporting member 19 that is associated with the supply roller 403; 603; 803 and is also referred to and serves as the supply roller supporting member 19 and/or anilox roller supporting member 19 and/or transfer supporting member 19. The at least one transfer supporting member 19 is preferably a component of the at least one positioning device 43. This transfer supporting member 19 may be configured as a single integral part, for example. Preferably, however, this transfer supporting member 19 is configured as a multipart assembly 19. The flexographic application mechanism 414; 614; 814 further preferably has at least two such transfer supporting members 19 associated with the supply roller 403; 603; 803, one being associated with each of the two roller journals 18 of the supply roller 403; 603; 803. The supply roller 403; 603; 803 preferably is and/or can be connected at each of its roller journals 18 to the respective transfer supporting member 19, in each case via at least one rolling bearing 27 that preferably rotatably supports the supply roller 403; 603; 803. In the foregoing and/or in the following, when aspects relating to one axial end of the supply roller 403; 603; 803 are described, in particular relating to its roller journals 18 and/or relating to its rolling bearings 27 and/or relating to the associated transfer supporting member 19 and/or relating to a main supporting member 06 and/or relating to a bearing and/or relating to a cooperation with a chamber doctor blade system 401; 601; 801, these aspects are preferably configured likewise at the opposite axial end of the supply roller 403; 603; 803, unless otherwise described and provided no contradictions would result.

At least one bearing seat 44 is preferably provided, which serves and/or is provided for bearing at least one rolling bearing 27 of the supply roller 403; 603; 803. At least one component 46; 47 of said bearing seat 44 is preferably arranged, in particular permanently, on the respective transfer supporting member 19. Said bearing seat 44 preferably has at least one first component 47, which more preferably is configured as a lower component 47 and/or which preferably has at least one bearing point 48 or bearing surface 48 for at least one respective rolling bearing 27 of the respective supply roller 403; 603; 803. Said bearing seat 44 preferably has at least one second component 46, which is preferably configured as an upper component 46 and/or which preferably has at least one fixing point 49 or fixing surface 49 for fixing a respective rolling bearing 27 of the respective supply roller 403; 603; 803 in place in contact with the respective bearing point 48 or bearing surface 48. When the bearing seat 44 is closed, at least one respective rolling bearing 27 is preferably fixed, in particular clamped, between the first component 47, in particular the bearing point 48 or bearing surface 48 thereof, on the one hand, and the second component 46, in particular the fixing point 49 or fixing surface 49 thereof, on the other hand.

In a possible first embodiment, the bearing seat 44 is fully connected to the transfer supporting member 19 and/or is configured entirely as a component of the transfer supporting member 19. In that case, the bearing seat 44 can preferably be opened by moving its second, in particular upper component 46 in particular upward, for example manually and/or automatically, relative to its other, in particular lower component 47 and relative to the transfer supporting member 19. Such a movement may be or may include a pivoting movement, for example. An appropriate drive is preferably provided for automation. Alternatively, the bearing seat 44 is closed in that, when the transfer supporting member 19 is moved, the upper component 46 is pressed against at least one receiving stop, and with a further movement of the transfer supporting member 19, this at least one receiving stop forces the upper component 46 into a path that effects a movement of the upper component 46 relative to the lower component 47, thereby closing the bearing seat 44.

Figure 9A:
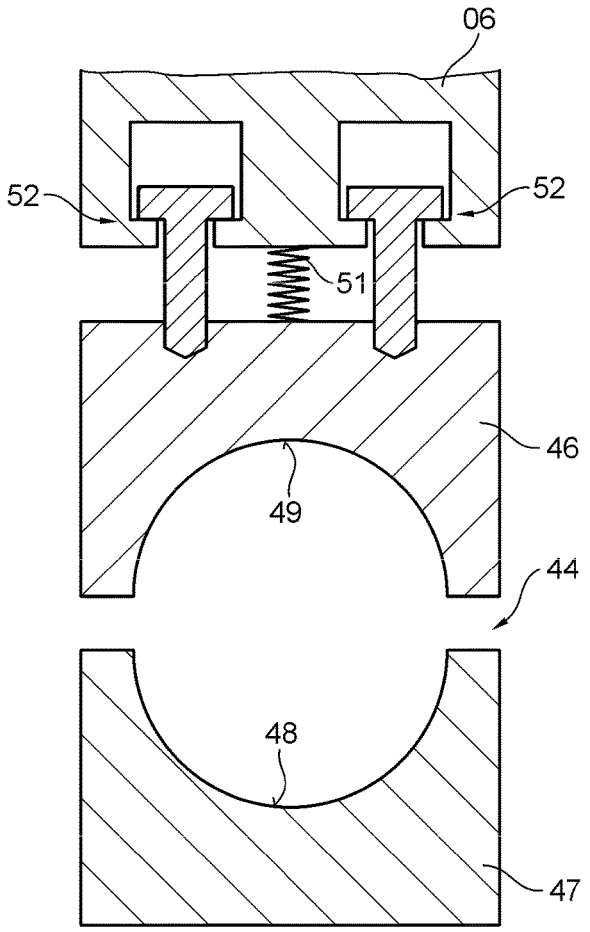
FIG. 9*a* a schematic representation of a bearing seat for a supply roller in an opened state.
Figure 9B:
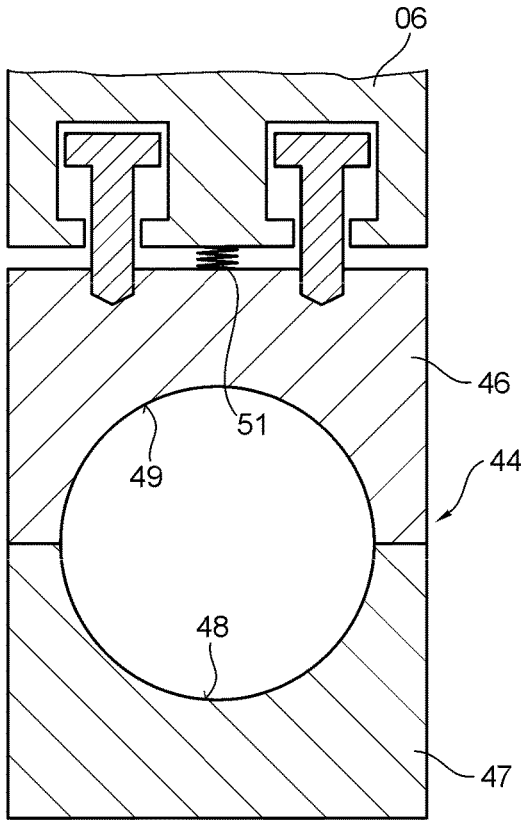
FIG. 9*b* a schematic representation according to FIG. 9*a* in a closed state.
Figure 10A:
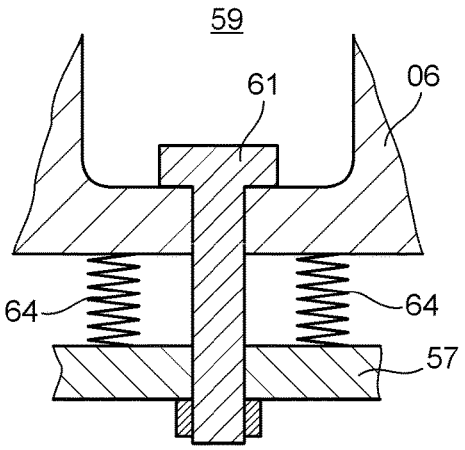
FIG. 10*a* a schematic representation of a suspension mounting of a reservoir supporting member on a main supporting member in a suspended position.
Figure 10B:
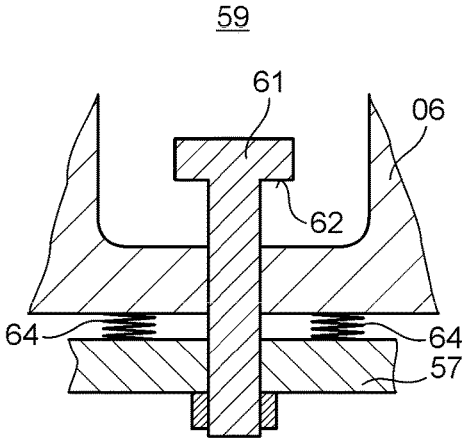
FIG. 10*b* a schematic representation according to FIG. 10*a* in a raised position.
Figure 11A:
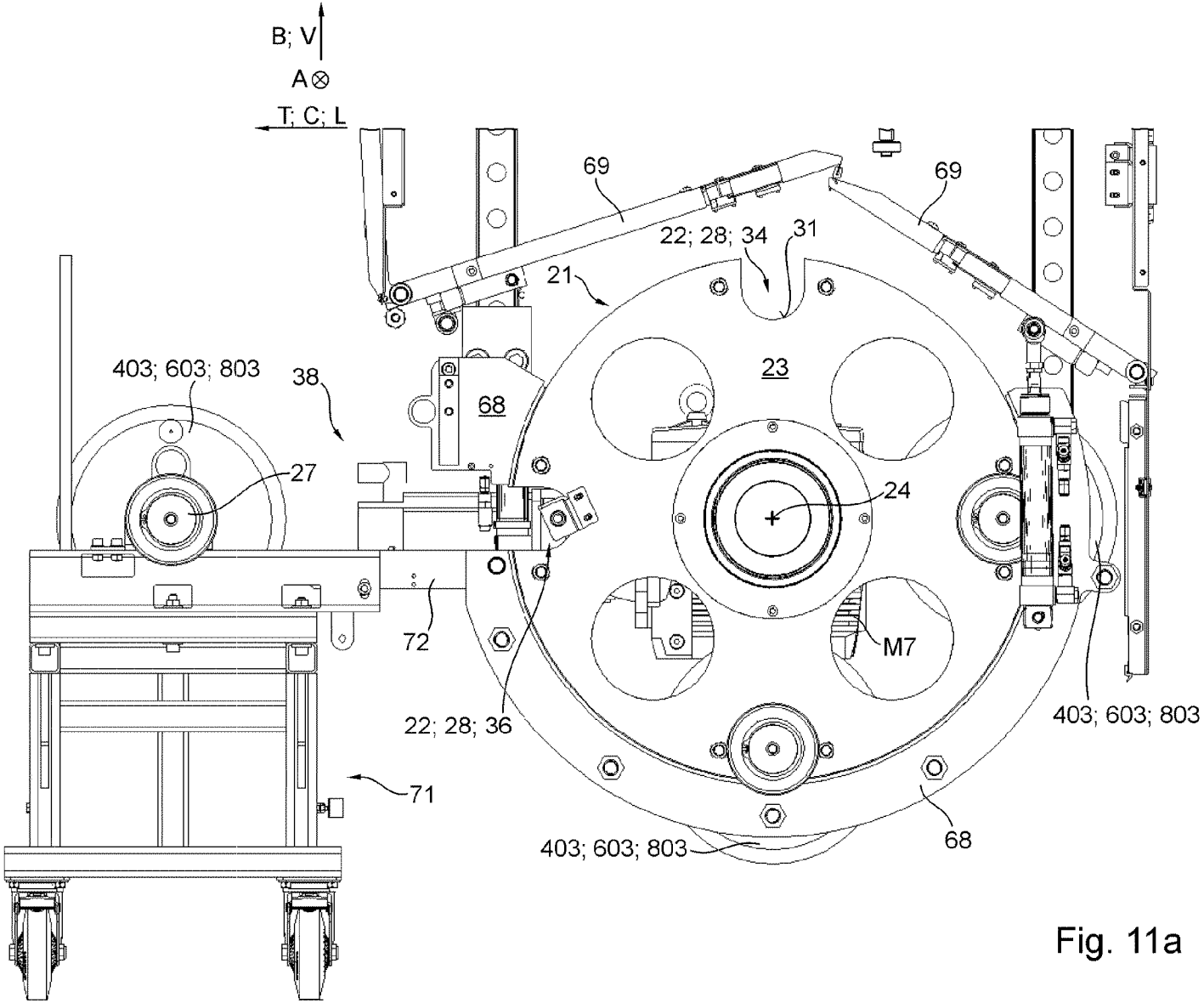
FIG. 11*a* a schematic representation of a magazine with the locking element opened.
Figure 11B:
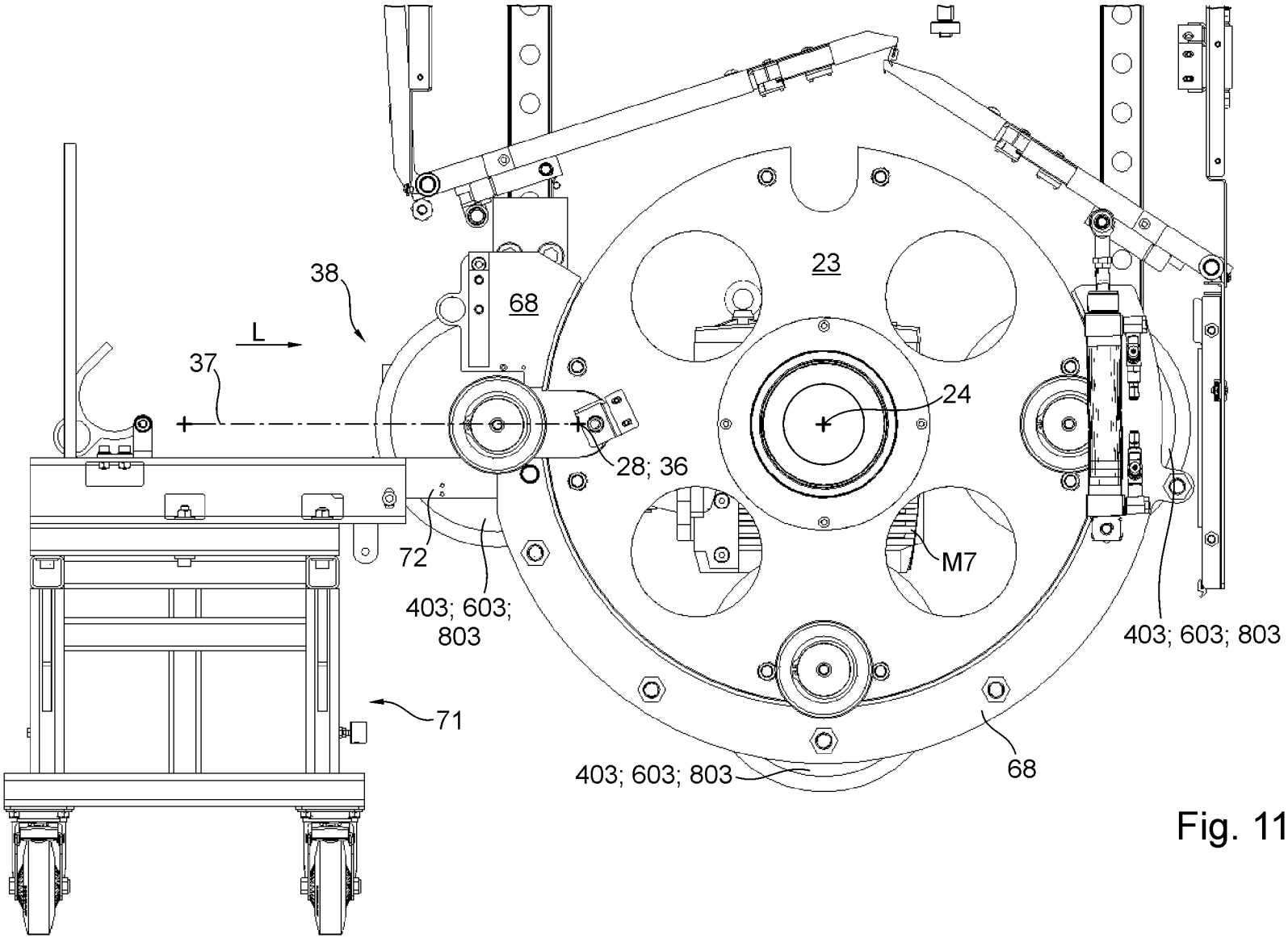
FIG. 11*b* a schematic representation according to FIG. 11*a*, in which a supply roller is located between a loading position of the magazine and a delivery device.
Figure 11C:
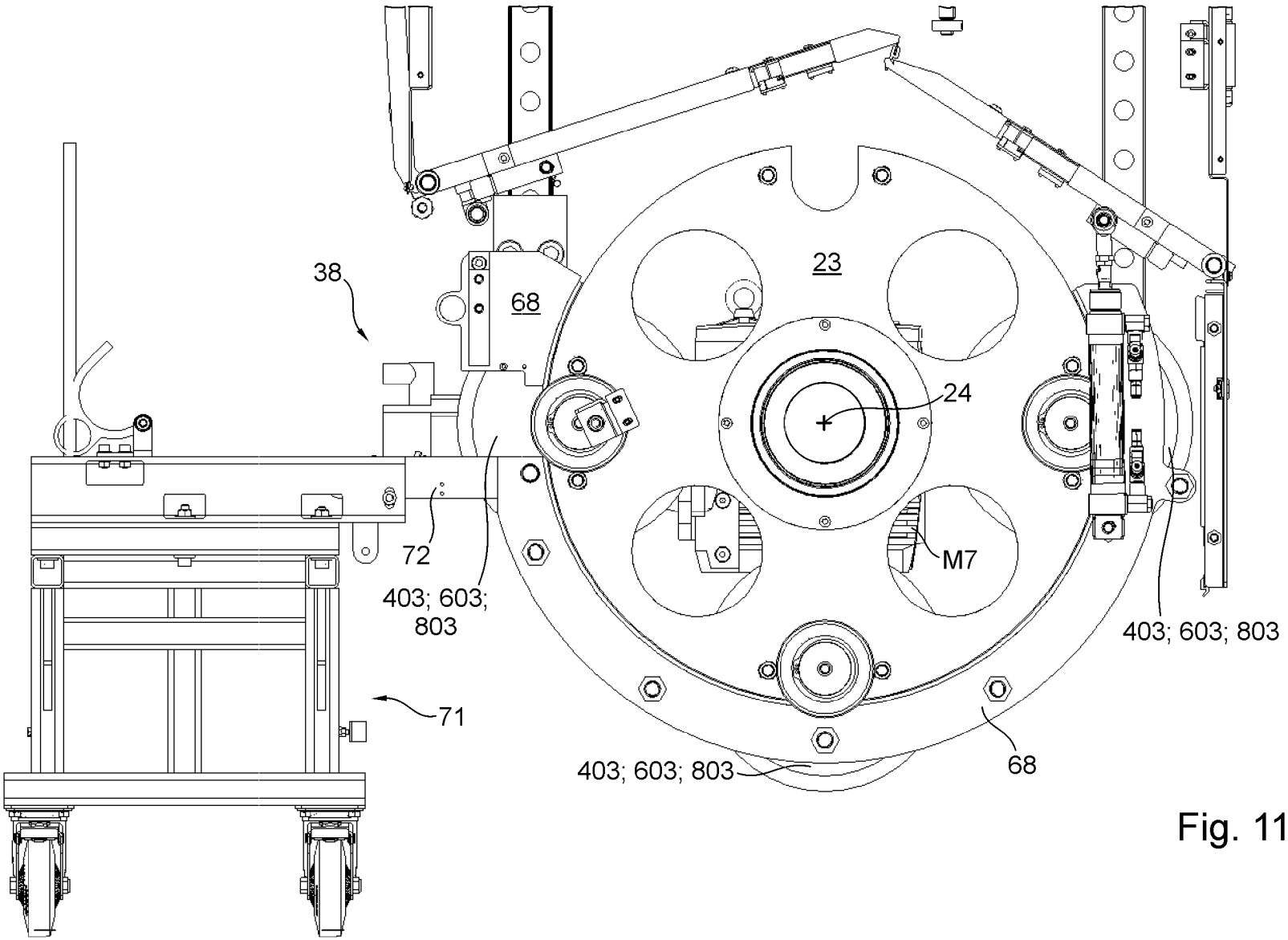
FIG. 11*c* a schematic representation according to FIG. 11*c*, in which the supply roller is arranged in the loading position.
Figure 11D:
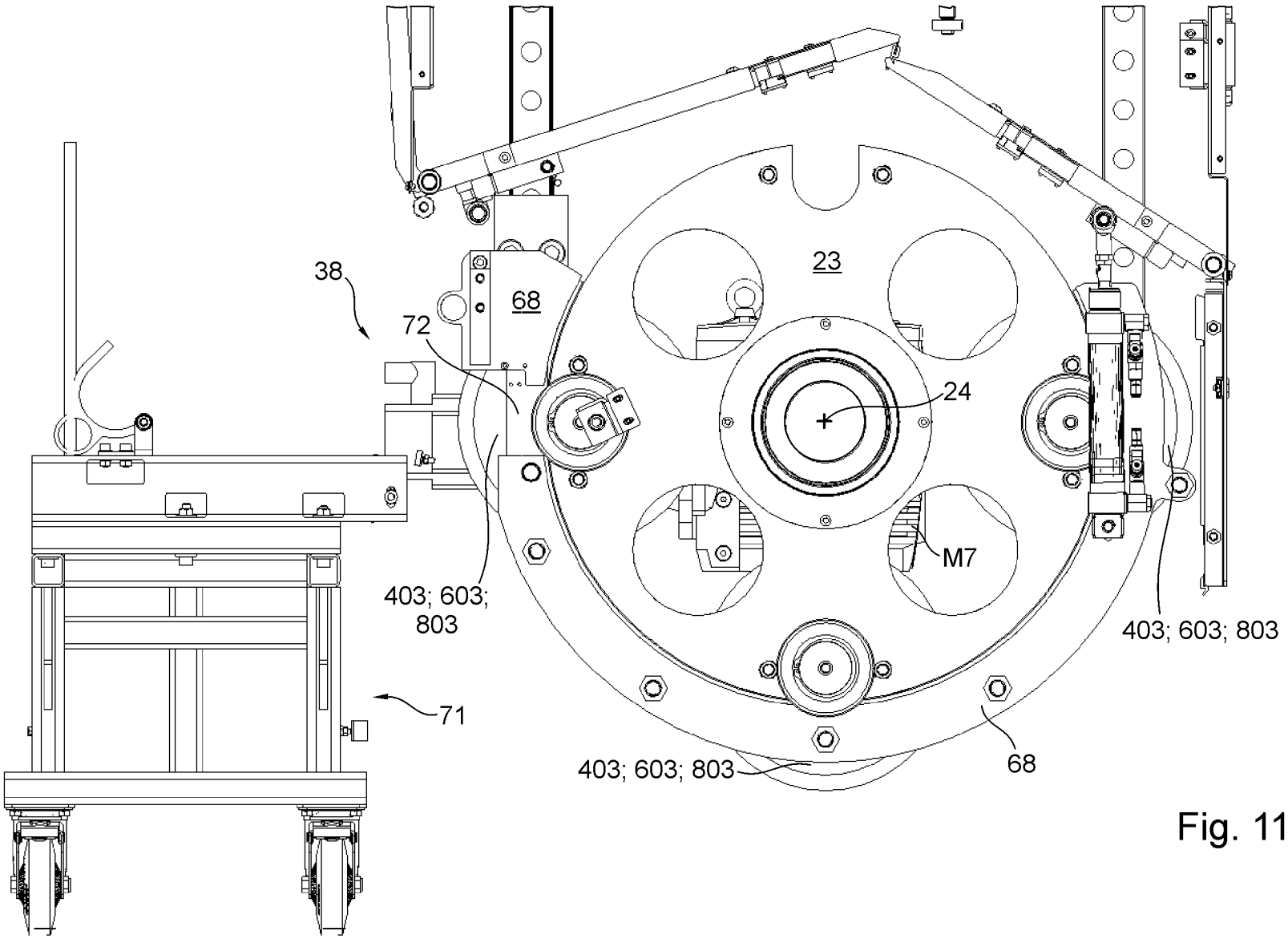
FIG. 11*d* a schematic representation according to FIG. 11*c*, in which the locking element is closed.
Figure 12:
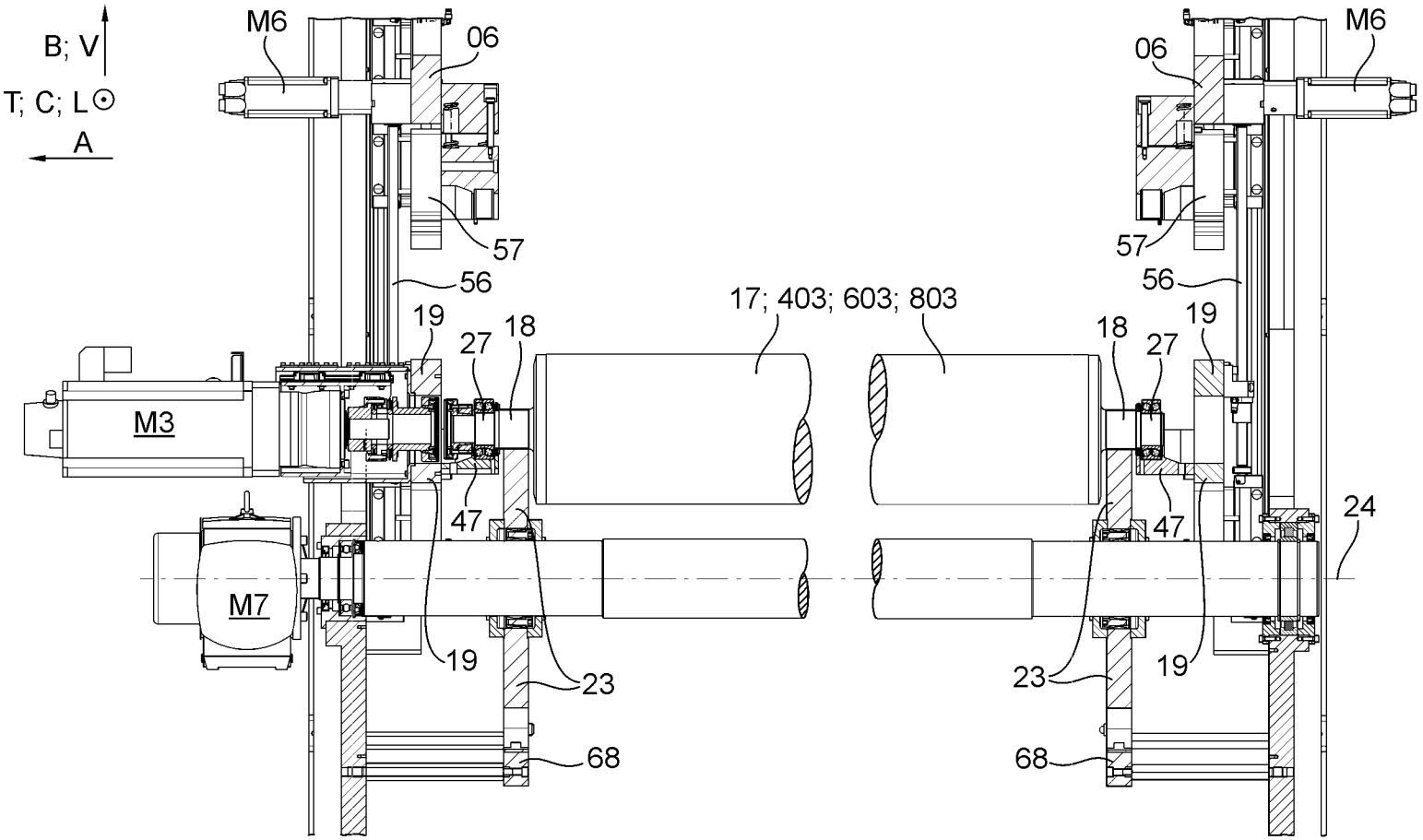
FIG. 12 a schematic representation of part of the application unit, in which the supply roller is arranged in a magazine receptacle of the magazine and at the same time is in contact with the transfer supporting member.

In a preferred second embodiment of the bearing seat 44, at least one component 47 of the bearing seat 44 is arranged, in particular permanently, on the respective transfer supporting member 19, in particular rigidly, and at least one further component 46 of the bearing seat 44 is arranged, in particular permanently, on a respective main supporting member 06. The components 46; 47 of the bearing seats 44 are then also moved relative to one another by a corresponding relative movement between the transfer supporting member 19, on the one hand, and the main supporting member 06, on the other hand, thereby opening or closing said bearing seats. In a preferred embodiment, the upper component 46 of the bearing seat 44 is arranged pre-loaded by at least one spring element 51 against the main supporting member 06 via at least one guide element 52. The corresponding rolling bearing 27 is then held securely in the bearing seat 44 even with a slight relative movement between transfer supporting member 19, on the one hand, and main supporting member 06, on the other hand. (Such a second embodiment of the bearing seat 44 is also depicted by way of example in FIGS. 9*a* and 9*b*.)

The at least one transfer supporting member 19 is preferably arranged to be movable relative to the frame 427; 627; 827 of the application unit 400; 600; 800 or the flexographic application mechanism 414; 614; 814, in particular to be movable linearly and/or along the at least one of the at least one linear guide 07. In particular, the at least one transfer supporting member 19 preferably performs every movement performed by the main supporting member 06 closest to it in the flexographic application mechanism 414; 614; 814. For this purpose, the at least one transfer supporting member 19 is preferably coupled, via a mechanical coupling 53, to the main supporting member 06 closest to it in the flexographic application mechanism 414; 614; 814. This coupling 53 is preferably adjustable. The at least one transfer supporting member 19 is preferably arranged to be movable, in particular linearly movable, relative to the main supporting member 06 closest to it in the flexographic application mechanism 414; 614; 814. The at least one transfer supporting member 19 is preferably arranged to be movable, in particular linearly and/or in and/or counter to the positioning direction B, guided by at least one guide 07. Preferably, the at least one transfer supporting member 19 is arranged to be movable, in particular linearly and/or in and/or counter to the positioning direction B, guided by the at least one main guide 07. Preferably, the at least one transfer supporting member 19 is arranged to be movable, guided by the same at least one main guide 07 as the main supporting member 06 closest to it in the flexographic application mechanism 414; 614; 814.

The at least one positioning device 43 preferably has at least one drive M6, referred to as the transfer drive M6. More preferably, each of the preferably two positioning devices 43 preferably has at least one and more preferably precisely one transfer drive M6. Accordingly, the flexographic application mechanism 414; 614; 814 preferably has a total of at least two and more preferably precisely two such transfer drives M6. The at least one transfer drive M6 preferably serves to adjust and/or to modify and/or if applicable to hold a position of a respective transfer supporting member 19 relative to the main supporting member 06 closest to it in the flexographic application mechanism 414; 614; 814 and/or along the at least one main guide 07. The at least one transfer drive M6 is preferably part of the coupling 53 between the transfer supporting member 19, on the one hand, and the main supporting member 06 closest to it in the flexographic application mechanism 414; 614; 814, on the other hand. The at least one transfer supporting member 19 is preferably arranged to be movable in and/or counter to the positioning direction B, in particular guided along the at least one linear guide 07, in particular by means of the respective transfer drive M6 and/or relative to the frame 427; 627; 827 of the flexographic application mechanism 414; 614; 814 and/or relative to the main supporting member 06 closest to it in the flexographic application mechanism 414; 614; 814. Preferably, the at least one supply roller 403; 603; 803 is arranged to be movable in and/or counter to the positioning direction B, in particular by means of the at least one transfer drive M6 and/or relative to the frame 427; 627; 827 of the flexographic application mechanism 414; 614; 814 and/or relative to the at least one main supporting member 06 of the flexographic application mechanism 414; 614; 814 and/or relative to the forme cylinder 402; 602; 802.

The at least one transfer drive M6 is preferably embodied as a motor M6, more preferably as an electric motor M6 and even more preferably as a closed loop position-controlled electric motor M6. At least one transfer gearing unit 54 of the flexographic application mechanism 414; 614; 814 is preferably provided. The at least one transfer gearing unit 54 preferably serves to convert a respective movement of the respective transfer drive M6 into a movement of the transfer supporting member 19, in particular in and/or counter to the positioning direction B. The at least one transfer gearing unit 54 is preferably a component of the at least one positioning device 43. The at least one transfer gearing unit 54 preferably has at least one transfer threaded rod 56. The transfer threaded rod 56 is preferably mounted to be rotatable, in particular rotatable by means of the respective transfer drive M6. At least one transfer mating thread that cooperates with a thread of the transfer threaded rod 56 is preferably arranged on the at least one transfer supporting member 19, in particular immovably relative to the transfer supporting member 19 at least during a positioning operation. The rotation of the at least one transfer threaded rod 56 then moves this transfer mating thread along the transfer threaded rod 56, thereby moving the at least one transfer supporting member 19 along the transfer threaded rod 56. The thread axis of the transfer threaded rod 56 is preferably oriented parallel to the positioning direction B. The respective transfer threaded rod 56 is preferably part of the coupling 53 between the transfer supporting member 19, on the one hand, and the main supporting member 06 closest to it in the flexographic application mechanism 414; 614; 814, on the other hand.

At least two such transfer threaded rods 56 are preferably provided. Two transfer supporting members 19 are preferably arranged as described. Preferably at least one, and more preferably precisely one, of the two transfer threaded rods 56 cooperates as described with each of the two transfer supporting members 19. The two transfer drives M6 can be driven synchronously, for example. Alternatively or additionally, the two transfer drives M6 can be actuated individually, in particular to create or to increase or to decrease or to eliminate an inclined position of the supply roller 403; 603; 803, in particular relative to the at least one forme cylinder 402; 602; 802.

Alternatively or additionally, the application unit 400; 600; 800 is preferably characterized in that the application unit 400; 600; 800 has at least one transfer position adjustment device, by means of which a relative position of the at least one transfer supporting member 19 relative to the at least one main supporting member 06 of the application unit 400; 600; 800 is determined, in particular independently of a relative position of the respective main supporting member 06 relative to the frame 427; 627; 827 of the application unit 400; 600; 800, and in that the transfer position adjustment device comprises at least one transfer drive M6. The transfer position adjustment device preferably comprises the at least one transfer gearing unit 54 and/or the at least one transfer threaded rod 56 and/or the at least one transfer mating thread and/or the at least one transfer drive M6. In place of the described transfer gearing unit 54 and/or transfer drives M6 and/or transfer mating thread, the at least one transfer adjustment device can alternatively have at least one other drive concept, for example at least one pneumatic and/or hydraulic linear drive, with or without stops for specific positions.

The at least one application fluid reservoir 401; 601; 801, preferably configured as a chamber doctor blade system 401; 601; 801, is preferably arranged so as to be movable. Such mobility is particularly advantageous for the movement and/or replacement and/or installation and/or uninstallation of the supply roller 403; 603; 803. During a normal application process, preferably at least one doctor blade of the chamber doctor blade system 401; 601; 801, more preferably at least one working doctor blade and at least one final doctor blade, is in contact with the supply roller 403; 603; 803. Further preferably, lateral seals of the chamber doctor blade system 401; 601; 801 are in contact with the supply roller 403; 603; 803 during a normal application process. In order to move the supply roller 403; 603; 803, either the chamber doctor blade system 401; 601; 801 must then be moved along with said supply roller or the chamber doctor blade system 401; 601; 801 must backed away from the supply roller 403; 603; 803, or vice versa.

The at least one application fluid reservoir 401; 601; 801 is preferably arranged to be movable together with the forme cylinder 402; 602; 802, on the one hand, in particular with the axis of rotation 39 thereof, and on the other hand to also be movable relative to the forme cylinder 402; 602; 802, in particular the axis of rotation 39 thereof. The at least one application fluid reservoir 401; 601; 801 is preferably arranged to be movable, in particular linearly movable, more preferably in and/or counter to a positioning direction B, in particular relative to the frame 427; 627; 827 of the flexographic application mechanism 414; 614; 814 and/or of the flexographic application unit 400; 600; 800.

The flexographic application mechanism 414; 614; 814 preferably has at least one supporting member 57 associated with the at least one application fluid reservoir 401; 601; 801, which is also referred to and serves as a reservoir supporting member 57 and/or doctor blade system supporting member 57. The at least one application fluid reservoir 401; 601; 801 is preferably arranged connected directly or indirectly to the at least one reservoir supporting member 57 and/or such that it can be moved together with the at least one reservoir supporting member 57. The at least one reservoir supporting member 57 is preferably a component of the at least one positioning device 43. This reservoir supporting member 57 may be configured as a single integral part, for example. Preferably, however, this reservoir supporting member 57 is configured as a multipart assembly 57. At least one connecting device 58, preferably configured as a pivot joint 58, is preferably arranged on the at least one reservoir supporting member 57, in particular as part of the at least one reservoir supporting member 57. Preferably, the at least one application fluid reservoir 401; 601; 801 is connected to at least one part of the at least one reservoir supporting member 57 via the at least one connecting device 58. More preferably, the flexographic application mechanism 414; 614; 814 has at least two such reservoir supporting members 57 associated with the at least one application fluid reservoir 401; 601; 801, each of said supporting members being associated with one axial end of the at least one application fluid reservoir 401; 601; 801. The at least one application fluid reservoir 401; 601; 801 preferably is and/or can be connected at each of its axial ends to the respective reservoir supporting member 57, at each end via at least one connecting device 58. In the foregoing and/or in the following, when aspects relating to one axial end of the at least one application fluid reservoir 401; 601; 801, in particular relating to the associated reservoir supporting member 57 and/or relating to a main supporting member 06 and/or relating to a transfer supporting member 19 and/or relating to a cooperation with a supply roller 403; 603; 803 are described, these aspects are preferably configured likewise at the opposite axial end of the at least one application fluid reservoir 401; 601; 801, unless otherwise described and provided no contradictions would result.

The at least one reservoir supporting member 57 is preferably arranged such that it is movable, in particular linearly movable, relative to the frame 427; 627; 827 of the application unit 400; 600; 800 or of the flexographic application mechanism 414; 614; 814. The at least one reservoir supporting member 57 is preferably arranged to be movable, in particular linearly movable, relative to the main supporting member 06 closest to it in the flexographic application mechanism 414; 614; 814. The at least one reservoir supporting member 57 is preferably connected to the main supporting member 06 closest to it in the flexographic application mechanism 414; 614; 814 via a suspension mount 59. The suspension mount 59 preferably permits a limited, in particular passive relative movement, in particular oriented in and/or counter to the positioning direction B, between the main supporting member 06, on the one hand, and the reservoir supporting member 57, on the other hand. This relative movement is preferably limited to a maximum of 15 cm, more preferably to a maximum of 10 cm, and even more preferably to a maximum of 5 cm. Such a relative movement is preferably possible over a length of at least 5 mm, more preferably over a length of at least 10 mm, even more preferably over a length of at least 15 mm. At least one extension stop element 61 of the suspension mount 59 is preferably arranged to be movable, in particular displaceable, relative to the main supporting member 06 and/or the reservoir supporting member 57. For example, the at least one extension stop element 61 is fixed to the reservoir supporting member 57 such that the relative position of said stop element is adjustable. The at least one extension stop element 61 is preferably arranged to be movable at least linearly relative to the main supporting member 06. The at least one extension stop element 61 preferably has at least one extension stop surface 62, which determines the maximum distance between the main supporting member 06, on the one hand, and the reservoir supporting member 57, on the other hand. Shorter distances are preferably possible. At least one spring element 64 is preferably provided, which forces the reservoir supporting member 57 away from the main supporting member 06, preferably assisted by the force of gravity acting on the reservoir supporting member 57.

The at least one reservoir supporting member 57 is preferably arranged to be movable, in particular linearly and/or in and/or counter to the positioning direction B, guided by at least one guide 07. Preferably, the at least one reservoir supporting member 57 is arranged to be movable, in particular linearly and/or in and/or counter to the positioning direction B, guided by the at least one main guide 07. Preferably, the at least one reservoir supporting member 57 is arranged to be movable, guided by the same at least one main guide 07 as the main supporting member 06 closest to it in the flexographic application mechanism 414; 614; 814 and/or as the transfer supporting member 19 closest to it.

The at least one reservoir supporting member 57 is preferably movable exclusively passively. In an application operation, the at least one reservoir supporting member 57 is held in its position in that the transfer supporting member 19 that is closest to it presses it, in particular from below and/or in particular via at least one, more preferably adjustable thrust stop 63, against the main supporting member 06 that is closest to it. To back said transfer supporting member 19 away from the main supporting member 06, for example, by lowering the transfer supporting member 19, the reservoir supporting member 57 held by said transfer supporting member is likewise backed away, in particular lowered, from the main supporting member 06. This backing away movement, in particular lowering movement, of the reservoir supporting member 57 is preferably limited, however, in particular in that beyond a certain distance, the at least one extension stop surface 62 of the at least one extension stop element 61 comes into contact with the main supporting member 06. If the transfer supporting member 19 will be backed away further, in particular lowered, the reservoir supporting member 57 will be held from that point on by the main supporting member 06. Preferably, therefore, no drive is provided with which the reservoir supporting member 57 could be moved independently of the transfer supporting member 19 and independently of the main supporting member 06. Alternatively or additionally, the application unit 400; 600; 800 is preferably characterized in that the positioning device 43 has at least one thrust stop 63, in particular adjustable, which is provided as a contact element 63 for contact between the at least one transfer supporting member 19, on the one hand, and the at least one reservoir supporting member 57, on the other.

On the at least one reservoir supporting member 57, at least one reservoir positioning element 66 is preferably provided, by means of which a reservoir positioning movement of the application fluid reservoir 401; 601; 801, backing it away from the supply roller 403; 603; 803, is enabled. This reservoir backing-away movement preferably extends along a reservoir positioning path, which further preferably is at least also oriented at least partially in at least one direction that is oriented orthogonally to the positioning direction B. For example, the reservoir backing-away movement is a pivoting movement, in particular around the at least one connecting device 58, which is preferably configured as a pivot joint 58. The at least one reservoir positioning element 66 is configured, for example, as a pneumatic cylinder 66 or as a hydraulic cylinder 66 or as an electric drive 66. The at least one reservoir positioning element 66 is preferably part of the at least one positioning device 43. The at least one application fluid reservoir 401; 601; 801 is attached to at least one mounting element 67, for example. The at least one mounting element 67 preferably is a component of the at least one reservoir supporting member 57 and/or is connected to a remaining part of the at least one reservoir supporting member 57 via the at least one connecting device 58, which is preferably configured as a pivot joint 58. The at least one reservoir positioning element 66 is preferably arranged supported both on the at least one mounting element 67 and on the remaining part of the at least one reservoir supporting member 57.

At least one application unit 400; 600; 800 is preferably characterized in that the application unit 400; 600; 800 has at least one application mechanism 414; 614; 814 having at least one impression cylinder 408; 608; 808, at least one forme cylinder 402; 602; 802, and at least one supply roller 403; 603; 803, along with at least one positioning device 43, and in that the positioning device 43 further preferably has at least one linear guide 07. Alternatively or additionally, the application unit 400; 600; 800 is preferably characterized in that at least one main supporting member 06 is provided, on which the forme cylinder 402; 602; 802 is rotatably arranged by means of at least one rolling bearing 26. Alternatively or additionally, the application unit 400; 600; 800 is preferably characterized in that the positioning device 43 has at least one main supporting member 06, which is arranged to be movable in and/or counter to a positioning direction B, guided along the at least one linear guide 07, and on which the forme cylinder 402; 602; 802 is rotatably arranged by means of at least one rolling bearing 26. Alternatively or additionally, the application unit 400; 600; 800 is preferably characterized in that the positioning device 43 has at least one transfer supporting member 19, which is arranged to be movable relative to the at least one main supporting member 06, in and/or counter to the positioning direction B and guided along the at least one linear guide 07, and on which at least one component 47 of the bearing seat 44 is preferably arranged, which is configured to receive a rolling bearing 27 arranged on the at least one supply roller 403; 603; 803, in particular to receive at least one outer ring of the at least one rolling bearing 27 and/or at least one component that is fixedly connected to such an outer ring.

Alternatively or additionally, the application unit 400; 600; 800 is preferably characterized in that the positioning device 43 has at least one reservoir supporting member 57 or doctor blade system supporting member 57, which is arranged to be movable relative to the at least one main supporting member 06 and also relative to the at least one transfer supporting member 19, in and/or counter to the positioning direction B and guided along the at least one linear guide 07, and on which an intermediate reservoir 404; 604; 804 for application fluid, configured in particular as a chamber doctor blade system 404; 604; 804, is arranged. Alternatively or additionally, the application unit 400; 600; 800 is preferably characterized in that the reservoir supporting member 57 is arranged at least partially between the at least one main supporting member 06 and the at least one transfer supporting member 19, as viewed in the positioning direction B, and/or in that the reservoir supporting member 57 is arranged at least partially between the at least one main supporting member 06 and the at least one transfer supporting member 19 along the at least one linear guide 07 and more preferably along at least precisely one linear guide 07. This means, in particular, that there is at least one straight line that is oriented parallel to the positioning direction B and that has a point of intersection with the at least one reservoir supporting member 57, which is arranged between a point at which the straight line intersects with the at least one main supporting member 06, on the one hand, and a point at which the straight line intersects with the at least one transfer supporting member 19, on the other hand.

Alternatively or additionally, the application unit 400; 600; 800 is preferably characterized in that the at least one main supporting member 06 is arranged guided by the same at least one linear guide 07 as the at least one transfer supporting member 19, and/or in that the at least one main supporting member 06 is arranged guided by the same at least one linear guide 07 as the at least one reservoir supporting member 57, and/or in that the at least one reservoir supporting member 57 is arranged guided by the same at least one linear guide 07 as the at least one reservoir supporting member 57, and/or in that the at least one main supporting member 06 and the at least one transfer supporting member 19 and the at least one reservoir supporting member 57 are arranged guided by the same at least one linear guide 07.

Alternatively or additionally, the application unit 400; 600; 800 is preferably characterized in that the at least one reservoir supporting member 57 is arranged to be movable linearly relative to the main supporting member 06 closest to it, and in that the at least one reservoir supporting member 57 is connected to said main supporting member 06 via a suspension mount 59. Alternatively or additionally, the application unit 400; 600; 800 is preferably characterized in that this suspension mount 59 permits a limited relative movement, oriented in and/or counter to the positioning direction B, between the main supporting member 06, on the one hand, and the reservoir supporting member 57, on the other hand.

Alternatively or additionally, the application unit 400; 600; 800 is preferably characterized in that at least one bearing seat 44 for mounting at least one rolling bearing 27 of the supply roller 403; 603; 803 is provided, and in that at least one component 47 of said bearing seat 44, which has at least one bearing point 48 or bearing surface 48 for the at least one respective rolling bearing 27, is permanently arranged on the respective transfer supporting member 19, and in that at least one further component 46 of the bearing seat 44, which has at least one fixing point 49 or fixing surface 49 for fixing the respective rolling bearing 27 in place in contact with the respective bearing point 48 or bearing surface 48, is permanently arranged on a respective main supporting member 06.

Alternatively or additionally, the application unit 400; 600; 800 is preferably characterized in that the application unit 400; 600; 800 has at least one magazine 21 for storing supply rollers 403; 603; 803, and in that the magazine 21 has at least two magazine receptacles 22, each for accommodating one supply roller 403; 603; 803, and in that the magazine 21 has at least one movable repositioning device 23, by means of which the at least two magazine receptacles 22 can be moved and placed in different magazine positions 28. The magazine receptacles 22 can preferably execute at least one, in particular closed, circulating movement. In particular, the magazine receptacles 22 can occupy any magazine positions 28 along a circulation path. Conversely, each magazine position 28 can preferably be occupied by multiple, in particular all, of the magazine receptacles 22, but by a maximum of one magazine receptacle 22 at any point in time. The circulating movement is preferably a pivoting movement and/or rotational movement about a magazine axis 24, the magazine axis 24 preferably being stationary, in particular stationary relative to the frame 427; 627; 827 of the flexographic application mechanism 414; 614; 814 and/or of the flexographic application unit 400; 600; 800.

Alternatively or additionally, the application unit 400; 600; 800 is preferably characterized in that at least one supply roller 403; 603; 803 can be moved by means of the at least one positioning device 43 along a roller positioning path 33 that is exclusively linear, in particular. More preferably, one end of said roller positioning path is identical to a supply position 29 and the other end of said positioning path is identical to one of the magazine positions 28; 34, which is further preferably configured as a magazine position 28; 34 of the magazine positions 28; 34 of the magazine 21 that is configured as a change position 34. A supply position 29 is preferably a position and/or a spatial area that, at least during an application operation of the application mechanism 414; 614; 814, is occupied by the at least one supply roller 403; 603; 803 that is arranged in the application mechanism 414; 614; 814, in particular by the specific supply roller 403; 603; 803 that is in contact with the forme cylinder 402; 602; 802 of the application mechanism 414; 614; 814 and/or with the packing 04 during said application operation.

Alternatively or additionally, the application unit 400; 600; 800 is preferably characterized in that the specific at least one component 47 of the bearing seat 44, which has at least one bearing point 48 or bearing surface 48 for the at least one respective rolling bearing 27, can be moved in or counter to the positioning direction B to such an extent that at least one supply roller 403; 603; 803 is in contact simultaneously with said bearing point 48 or bearing surface 48 of the bearing seat 44 and with an inner boundary surface 31 of a magazine receptacle 22 of the magazine 21. More preferably, this component 47 can be moved even further in or counter to the positioning direction B, in particular to place the corresponding supply roller 403; 603; 803 in the magazine receptacle 22. Alternatively or additionally, the application unit 400; 600; 800 is preferably characterized in that this at least one component 47 of the bearing seat 44 is arranged to be movable along the at least one linear guide 07, starting from a position in which the supply roller 403; 603; 803 is arranged in the supply position 29, supported by the bearing seat 44, over a rectilinear path, in particular, which is longer than the roller positioning path 33.

In one operating state of the application unit 400; 600; 800, at least one rolling bearing 27 of a supply roller 403; 603; 803 is preferably arranged in a bearing seat 44 that is movable, in particular by means of the at least one transfer supporting member 19, and the supply roller 403; 603; 803 is in contact with a forme cylinder 402; 602; 802 and/or the packing 04 thereof. In another operating state of the application unit 400; 600; 800, said at least one rolling bearing 27 of said supply roller 403; 603; 803 is preferably arranged in said bearing seat 44, which is movable, in particular, by means of the at least one transfer supporting member 19, and said supply roller 403; 603; 803 is arranged in a magazine receptacle 22 of the magazine 21. In yet another operating state of the application unit 400; 600; 800, said at least one rolling bearing 27 of said supply roller 403; 603; 803 is out of contact with said bearing seat 44, which is movable in particular by means of the at least one transfer supporting member 19, and said supply roller 403; 603; 803 is arranged in said magazine receptacle 22 of the magazine 21.

Alternatively or additionally, the application unit 400; 600; 800 is preferably characterized in that every bearing contact region of a supply roller 403; 603; 803, with which the supply roller 403; 603; 803 is in contact with said bearing seat 44 of the application unit 400; 600; 800, is located spaced apart with respect to a transverse direction A from every magazine contact region with which the supply roller 403; 603; 803 in a magazine receptacle 22 is in contact with the magazine 21. The bearing contact region is preferably an outer ring of the at least one rolling bearing 27 and/or at least one component that is fixedly connected to such an outer ring. The magazine contact region is a part of a roller barrel 17 of the supply roller 403; 603; 803, for example, but preferably is a part of a roller journal 18 of the supply roller 403; 603; 803.

The at least one positioning device 43 preferably comprises the at least one linear guide 07 and/or the at least one main supporting member 06 and/or the at least one main gearbox 08 and/or the at least one transfer supporting member 19 and/or the at least one transfer drive M6 and/or the at least one positioning drive M4 and/or the at least one transfer gearing unit 54 and/or the at least one reservoir supporting member 57 and/or the at least one thrust stop 63 and/or the at least one reservoir positioning element 66.

There are various relevant cases in which the chamber doctor blade system 401; 601; 801 will be moved. A first such case occurs when the flexographic application mechanism 414; 614; 814 needs to be adapted to a substrate 02 of a different thickness. In that case, the forme cylinder 402; 602; 802 is preferably moved relative to the impression cylinder 408; 608; 808 to set an appropriate distance. The supply roller 403; 603; 803 is also preferably moved to maintain or restore an appropriate contact with the forme cylinder 402; 602; 802. Further, the chamber doctor blade system 401; 601; 801 is preferably moved together with the supply roller 403; 603; 803, to prevent an unintentional leakage of application fluid and/or damage to the supply roller 403; 603; 803 and/or to the chamber doctor blade system 401; 601; 801. Forme cylinder 402; 602; 802, supply roller 403; 603; 803, and chamber doctor blade system 401; 601; 801 are preferably moved jointly for this purpose.

A second such case occurs when a new packing 04 will be placed on the forme cylinder 402; 602; 802 and/or an old packing 04 will be removed from the forme cylinder 402; 602; 802. In that case, the forme cylinder 402; 602; 802 is preferably moved relative to the impression cylinder 408; 608; 808, for example by at least 15 cm and/or by at most 40 cm, in order to create sufficient space. Further, the supply roller 403; 603; 803 is preferably moved relative to the forme cylinder 402; 602; 802, for example by at least 10 mm and/or by at most 30 mm, in order to create sufficient space. The chamber doctor blade system 401; 601; 801 is preferably moved together with the supply roller 403; 603; 803 to prevent any unintentional leakage of application fluid. (Such a positioning is also illustrated by way of example in FIGS. 5*a* to 5*d*.) The application unit 400; 600; 800 has at least one safety device 73, for example, which more preferably can be opened for the mounting and/or removal of a corresponding packing 04, and otherwise protects operators from a risk of injury.

A third such case occurs when a supply roller 403; 603; 803 will be installed, changed, or removed. In that case, the chamber doctor blade system 401; 601; 801 preferably is first backed away from the supply roller 403; 603; 803. Further, for example, the forme cylinder 402; 602; 802 is backed away from the impression cylinder 408; 608; 808, for example by at least 10 cm and at most 40 cm. The supply roller 403; 603; 803 preferably likewise performs this movement, due to the configuration of the positioning device 43. Afterward, the supply roller 403; 603; 803 is preferably moved further, for example into a magazine 21 of the application unit 400; 600; 800 or into a loading position. For this purpose, the supply roller 403; 603; 803 is moved downward by at least 400 mm and/or at most 600 mm, for example. (Corresponding positions are also illustrated by way of example in FIGS. 6*a* to 6*e*.) The application unit 400; 600; 800 has at least one covering device 69, for example, which further preferably can be opened to allow the transfer of a supply roller 403; 603; 803 between the application mechanism 414; 614; 814 and the magazine 21, and otherwise protects the magazine 21 and/or the supply rollers 403; 603; 803 arranged therein from soiling.

The application unit 400; 600; 800 preferably comprises the at least one magazine 21 for storing supply rollers 403; 603; 803. The at least one magazine 21 is preferably located below the application mechanism 414; 614; 814, more preferably such that the axis of rotation 39 of the forme cylinder 402; 602; 802 is located above the magazine 21 in the vertical direction V, even more preferably such that the axis of rotation 39 of the forme cylinder 402; 602; 802 is located above the magazine axis 24 of the magazine 23 in the vertical direction V. The at least one magazine 21 preferably has at least two, more preferably at least three, even more preferably at least four, and more preferably still precisely four magazine receptacles 22, each for accommodating one supply roller 403; 603; 803. In this way, at least one supply roller 403; 603; 803 can always be held in reserve near its intended point of use in case a supply roller 403; 603; 803 currently in use might need to be replaced. Such a replacement typically occurs, for example, when a subsequent print job calls for a smaller or larger quantity of application fluid per unit of surface area.

A magazine receptacle 22 is understood here, in particular, as a defined spatial area that is intended to accommodate one supply roller 403; 603; 803 and preferably has the dimensions thereof. The respective magazine receptacle 22 is preferably defined by at least one boundary and/or at least one component and/or at least one surface and is preferably movable. Said boundary or said component or said surface does not need to fully enclose the corresponding spatial area. It is sufficient for bearing regions for roller journals 18 to be defined, for example, from which the position of the entire supply roller 403; 603; 803 then results. When the specific boundaries and/or components and/or surfaces that define the magazine receptacle 22 are at least partially moved, then the magazine receptacle 22 and particularly also any respective supply roller 403; 603; 803 that may be located in the magazine receptacle 22, preferably also move along with these.

The magazine 21 preferably has at least one movable repositioning device 23, by means of which the at least two magazine receptacles 22 can be moved and placed in different magazine positions 28. A magazine position 28 in this context is understood, in particular, as a defined spatial area that is intended to accommodate one supply roller 403; 603; 803. While a magazine receptacle 22 is defined at all times by the position of physical components of the magazine 21 and is therefore preferably movable, a respective magazine position 28 refers to a very specific position of a corresponding magazine receptacle 22, in particular regardless of whether or not a magazine receptacle 22 or even a supply roller 403; 603; 803 is actually disposed in said position. A respective magazine position 28 is thus defined in space and is preferably stationary, in particular stationary with respect to the frame 427; 627; 827 of the flexographic application mechanism 414; 614; 814 and/or of the flexographic application unit 400; 600; 800.

The at least one movable repositioning device 23 is preferably pivotable and/or rotatable about the magazine axis 24. Two repositioning devices 23 are provided, for example, in particular spaced apart from one another in the transverse direction A, and are arranged to be pivotable and/or rotatable about a common magazine axis 24. These two repositioning devices 23 are preferably connected to one another via a magazine shaft. The at least one repositioning device 23 is preferably arranged to be movable by means of at least one drive M7, also referred to as magazine drive M7, in particular in that the magazine drive M7 effects a pivoting movement or rotational movement about the magazine axis 24. The at least one magazine drive M7 is preferably configured as a motor M7, more preferably as a closed loop position-controlled electric motor, in particular.

One example of such boundaries and/or components and/or surfaces that define the magazine receptacle 22 is at least one inner boundary surface 31 and/or at least one outer boundary surface 32. Alternatively or additionally, the application unit 400; 600; 800 is preferably characterized in that magazine receptacles 22, in particular at least all of such magazine receptacles 22 that are connected to the repositioning device 23, are at least also defined by at least one respective movable inner boundary surface 31, which in particular is movable relative to the frame 427; 627; 827 of the application unit 400; 600; 800 and which is intended for contact with a roller journal 18 or a roller barrel 17 of a respective supply roller 403; 603; 803, said at least one inner boundary surface 31 preferably being configured as part of the repositioning device 23. The respective inner boundary surface 31 is preferably concave and, when oriented appropriately, preferably forms a type of shell in which the roller journal 18 can be held, in particular against the force of gravity. The at least one inner boundary surface 31 is preferably a surface 31 of the repositioning device 23.

Since the magazine receptacles 22 can preferably execute a circulating movement, as described above, situations also arise in which the inner boundary surface 31 is not sufficient to hold the supply roller 403; 603; 803 in the magazine receptacle 22 against the force of gravity. For that reason, the magazine receptacles 22 are configured as lockable, for example. This can be accomplished by means of a locking mechanism that circulates together with the magazine receptacle 22. Preferably, however, the application unit 400; 600; 800 is characterized in that such magazine receptacles 22, which are arranged in a magazine position 28 of a first subset of all possible magazine positions 28, in addition to being defined by the at least one inner boundary surface 31, are at least also defined by at least one respective fixedly arranged outer boundary surface 32, configured for contact with a roller journal 18 or a roller barrel 17 of a respective supply roller 403; 603; 803. The respective outer boundary surface 32 is preferably arranged stationary relative to the frame 427; 627; 827 of the application unit 400; 600; 800, in particular relative to the frame 427; 627; 827, relative to which the repositioning device 23 and the inner boundary surface 31 are movably arranged.

Preferably, the magazine 21 has at least one outer boundary member 68. The at least one outer boundary member 68 is preferably arranged in a stationary manner, in particular stationary relative to the frame 427; 627; 827 of the application unit 400; 600; 800. The at least one outer boundary surface 32 is preferably a surface 32 of the at least one outer boundary member 68. The shape of the at least one outer boundary member 68 and/or of the at least one outer boundary surface 32 is preferably adapted to a movement path of the at least one repositioning device 23. This preferably ensures that the magazine receptacles 22 are always closed sufficiently in the relevant regions to prevent supply rollers 403; 603; 803 from moving unintentionally or even falling out. The at least one repositioning device 23 preferably has a rotationally symmetrical contour. For example, the at least one repositioning device 23 is configured as a cylindrical disk with indentations on its outer surface. The boundary surfaces of these indentations are preferably the inner boundary surfaces 31. Such a repositioning device 23 is preferably rotatably arranged. The magazine axis 24 preferably forms the center axis of this flat cylindrical disk. The cylindrical disk may have recesses for the purpose of weight reduction and may even be reduced to such an extent that it consists only of shells that comprise the inner boundary surfaces 31 and braces that connect these shells to a central supporting member. The at least one outer boundary member 68 preferably has at least a concave shape. More preferably, the outer boundary member 68 has a concave surface 32 in the form of a circular arc or a cylindrical shell segment, formed as the outer boundary surface 32. The magazine axis 24 preferably forms the center axis of this outer boundary surface 32 in the form of a circular arc or a cylindrical shell segment. When the at least one repositioning device 23 rotates, corresponding magazine receptacles 22 are then preferably closed off by the outer boundary surface 32, with the associated magazine positions 28 being defined by their position relative to the outer boundary member 68.

In one embodiment, the at least one repositioning device 23 can be pivoted and/or rotated about the magazine axis 24. The at least one repositioning device 23 preferably has at least two recesses, which form magazine receptacles 22. These recesses are preferably identical in structure. The at least two recesses are preferably each open in a radial direction with respect to the magazine axis 24. Each of the at least two recesses preferably has at least one inner boundary surface 31, which defines the minimum distance between a supply roller 403; 603; 803 and the magazine axis 24. Preferably, dimensions of each of the at least two recesses, each with respect to its radial direction, are greater than the diameter of the roller journals 27 at a respective point intended to be received in the respective magazine receptacle 22. These dimensions of each of the at least two recesses, each with respect to its radial direction, are preferably less than twice the diameter of the roller journals 27 at this respective point. Dimensions of each of the at least two recesses, each with respect to its circumferential direction, are preferably greater than the diameter of the roller journals 27 at the respective point intended to be received in the respective magazine receptacle 22. Preferably, these dimensions of each of the at least two recesses, each with respect to its circumferential direction, are less than twice the diameter of the roller journals 27 at this respective point, more preferably less than 110% of said diameter.

The at least one outer boundary surface 32 is preferably shaped such that its projection in the transverse direction A corresponds to a circular arc. The radius of said circular arc is preferably greater than the greatest distance of the repositioning device 23 from the magazine axis 24. The radius of said circular arc is preferably no more than 20%, more preferably no more than 10%, and even more preferably no more than 5% greater than the greatest distance of the repositioning device 23 from the magazine axis 24. The central angle of said circular arc is preferably at least 180°, more preferably at least 190°, and even more preferably at least 200°. A portion of said circular arc in which a respective normal vector has a component that points upward preferably extends over a central angle of at least 160°, more preferably at least 170°, and even more preferably at least 175°. In this way, every area in which there would otherwise be a risk of the supply roller 403; 603; 803 moving downward out of its magazine receptacle 22 can be covered.

The at least one outer boundary surface 32 is preferably covered with a material that has a relatively high coefficient of friction, for example rubber. Thus, when a roller journal 27 of a supply roller 403; 603; 803 is in contact with this outer boundary surface 32 while the repositioning device 23 is being rotated, the corresponding supply roller 403; 603; 803 is preferably set in a rolling motion along the outer boundary surface 32, in addition to its circulating movement in the circumferential direction. This rolling motion can be utilized, for example, by placing a cleaning device, for example a brush, in contact with a cylindrical roller surface of the supply roller 403; 603; 803. The supply roller 403; 603; 803 is then cleaned as it is being repositioned. A contact region intended for contact between supply roller 403; 603; 803 and cleaning device extends over an angular range of at least 45°, more preferably at least 90°, and even more preferably at least 110° around the magazine axis 24, for example.

Alternatively or additionally, the application unit 400; 600; 800 is preferably characterized in that by means of the at least one positioning device 43, at least one supply roller 403; 603; 803 can be moved along an exclusively linear roller positioning path 33, in particular, one end of which is identical to the supply position 29 and the other end of which is identical to one of the magazine positions 28; 34, in particular a change position 34. The change position 34 is preferably the specific magazine position 28; 34 in which a magazine receptacle 22 must be located in order for a direct changing of a supply roller 403; 603; 803 between the magazine 21, on the one hand, and the application mechanism 414; 614; 814, on the other hand, to be carried out. The roller positioning path 33 is preferably used in the movement of a supply roller 403; 603; 803, to throw said roller onto a forme cylinder 402; 602; 802 and/or to throw it off of a forme cylinder 402; 602; 802. The roller positioning path 33 preferably extends in and/or counter to the positioning direction B. The change position 34 is preferably the highest magazine position 28 a magazine receptacle 22 of the magazine 21 can occupy, and/or the magazine 21 is preferably located below the application mechanism 414; 614; 814.

Alternatively or additionally, the application unit 400; 600; 800 is preferably characterized in that at least one of the magazine positions 28, in particular the first, is the change position 34. The change position 34 preferably serves as the starting point for an infeed of a supply roller 403; 603; 803 to the application mechanism 414; 614; 814 and/or as the end point and/or intermediate point for a removal of a supply roller 403; 603; 803 from the application mechanism 414; 614; 814. Alternatively or additionally, the application unit 400; 600; 800 is preferably characterized in that, when a magazine receptacle 22 is located in the change position 34, a supply roller 403; 603; 803 can be transferred, in or counter to the positioning direction B, between said magazine receptacle 22, on the one hand, and a region of the roller positioning path 33 that is remote from said magazine 21, on the other hand, said positioning path connecting the magazine 21 to the application mechanism 414; 614; 814. For movements of supply rollers 403; 603; 803 between the change position 34 and the supply position 29, the at least one positioning device 43, in particular the at least one transfer supporting member 19, is preferably provided. For movements of supply rollers 403; 603; 803 between the change position 34 and other magazine positions 28, the at least one repositioning device 23 is preferably provided.

Alternatively or additionally, the application unit 400; 600; 800 is preferably characterized in that at least one of the magazine positions 28, in particular the second, is a loading position 36. The loading position 36 preferably serves as the starting point for transporting a supply roller 403; 603; 803 away from the application unit 400; 600; 800 and therefore preferably acts as an unloading position. Alternatively or additionally, the application unit 400; 600; 800 is preferably characterized in that, when a magazine receptacle 22 is located in the loading position 36, a supply roller 403; 603; 803 can be transferred along a loading path 37, which is linear in particular, in or counter to a loading direction L between said magazine receptacle 22, on the one hand, and a loading area 38, on the other. The loading area 38 is preferably a loading area 38 of the application unit 400; 600; 800.

Alternatively or additionally, the application unit 400; 600; 800 is preferably characterized in that the loading path 37 is formed as a linear loading path 37 and/or in that the loading direction L deviates from at least one horizontal direction C by no more than 30°, more preferably no more than 20°, even more preferably no more than 10°, and more preferably still no more than 5°, or is oriented horizontally. This horizontal direction C is preferably oriented orthogonally to the transverse direction A and/or to the axis of rotation 39 of the forme cylinder 402; 602; 802. The loading position 36 preferably also serves as the intake point for feeding a supply roller 403; 603; 803 into the application unit 400; 600; 800, and therefore preferably acts as an uploading position. Supply rollers 403; 603; 803 are preferably moved, in particular rolled, for example manually or automatically, along the loading path 37.

Figure 4A:
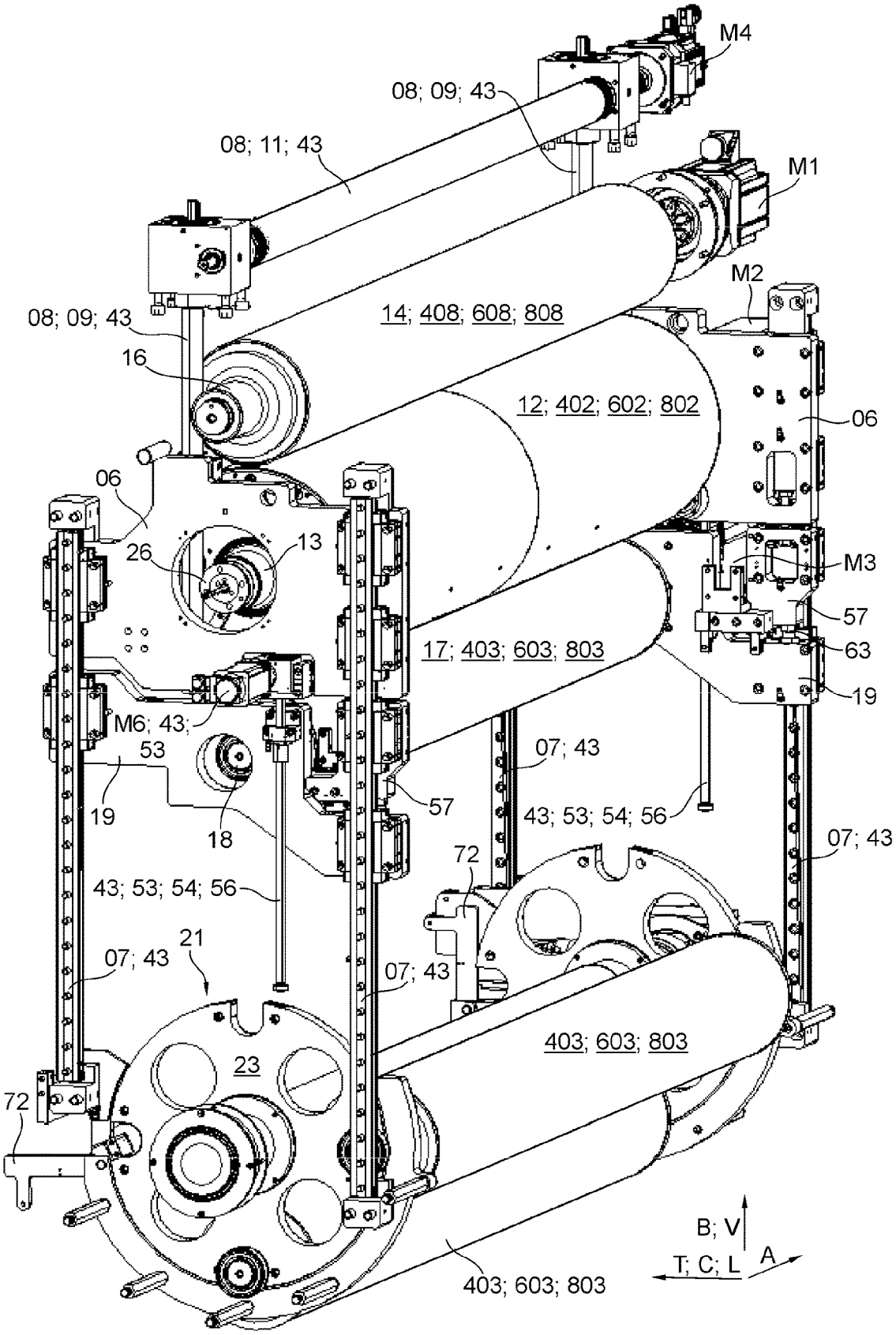
FIG. 4*a* a schematic partial representation of a flexographic application unit having a positioning device.
Figure 4B:
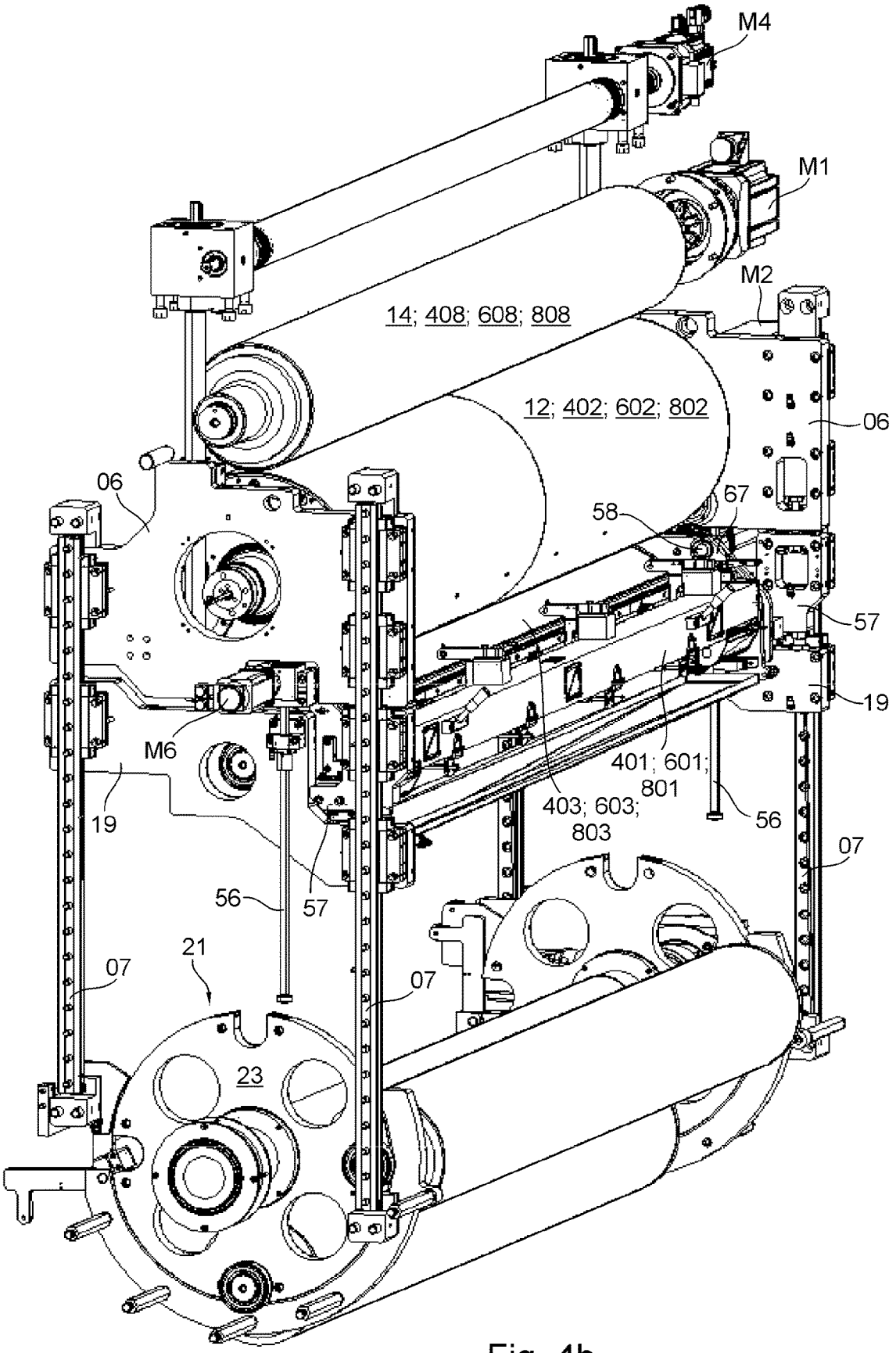
FIG. 4*b* a schematic representation according to FIG. 4*a*, additionally showing an application fluid reservoir.
Figure 4C:
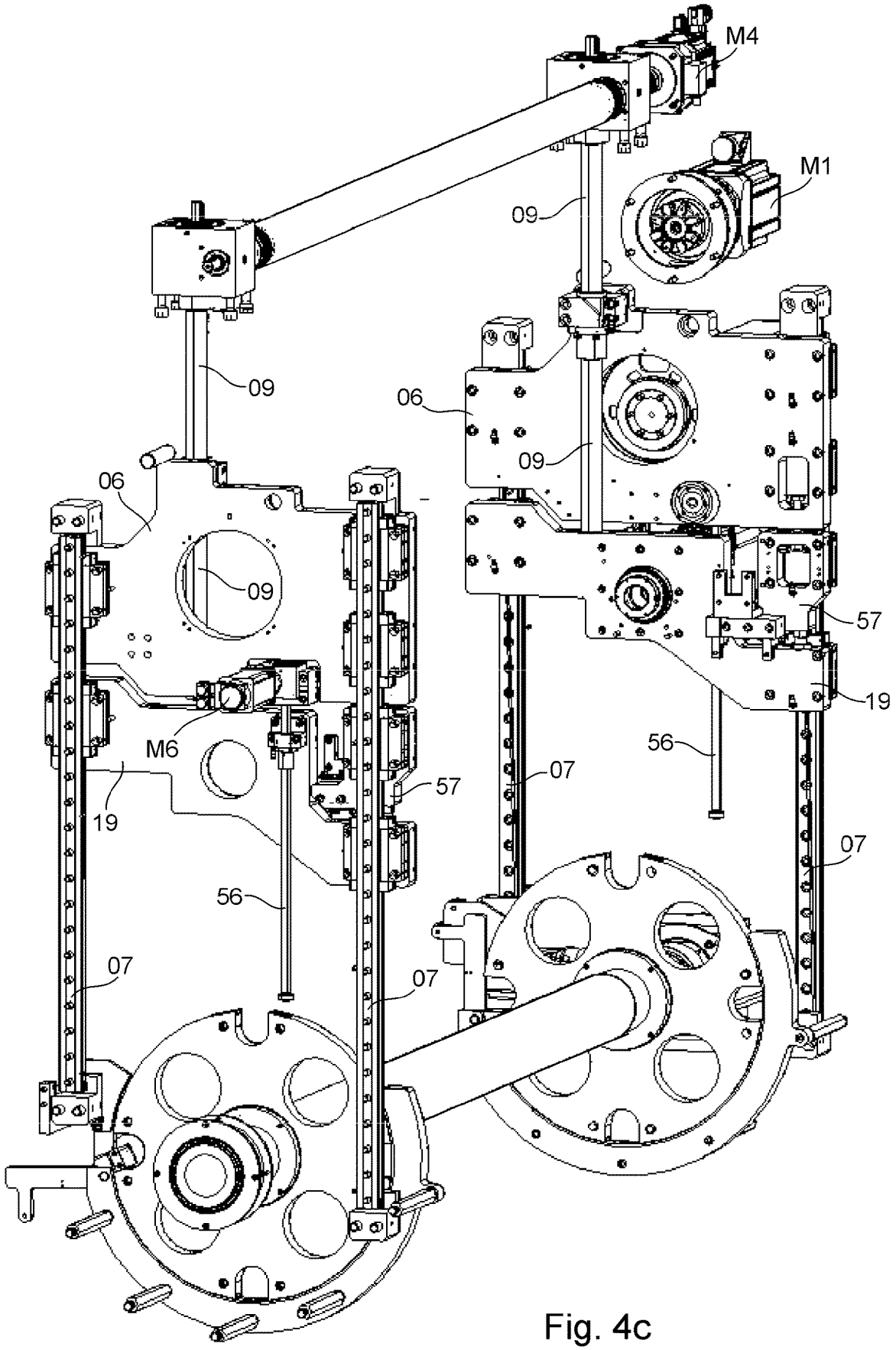
FIG. 4*c* a schematic representation according to FIG. 4*a*, in which an impression cylinder, a forme cylinder, and a supply roller are formed.
Figure 5A:
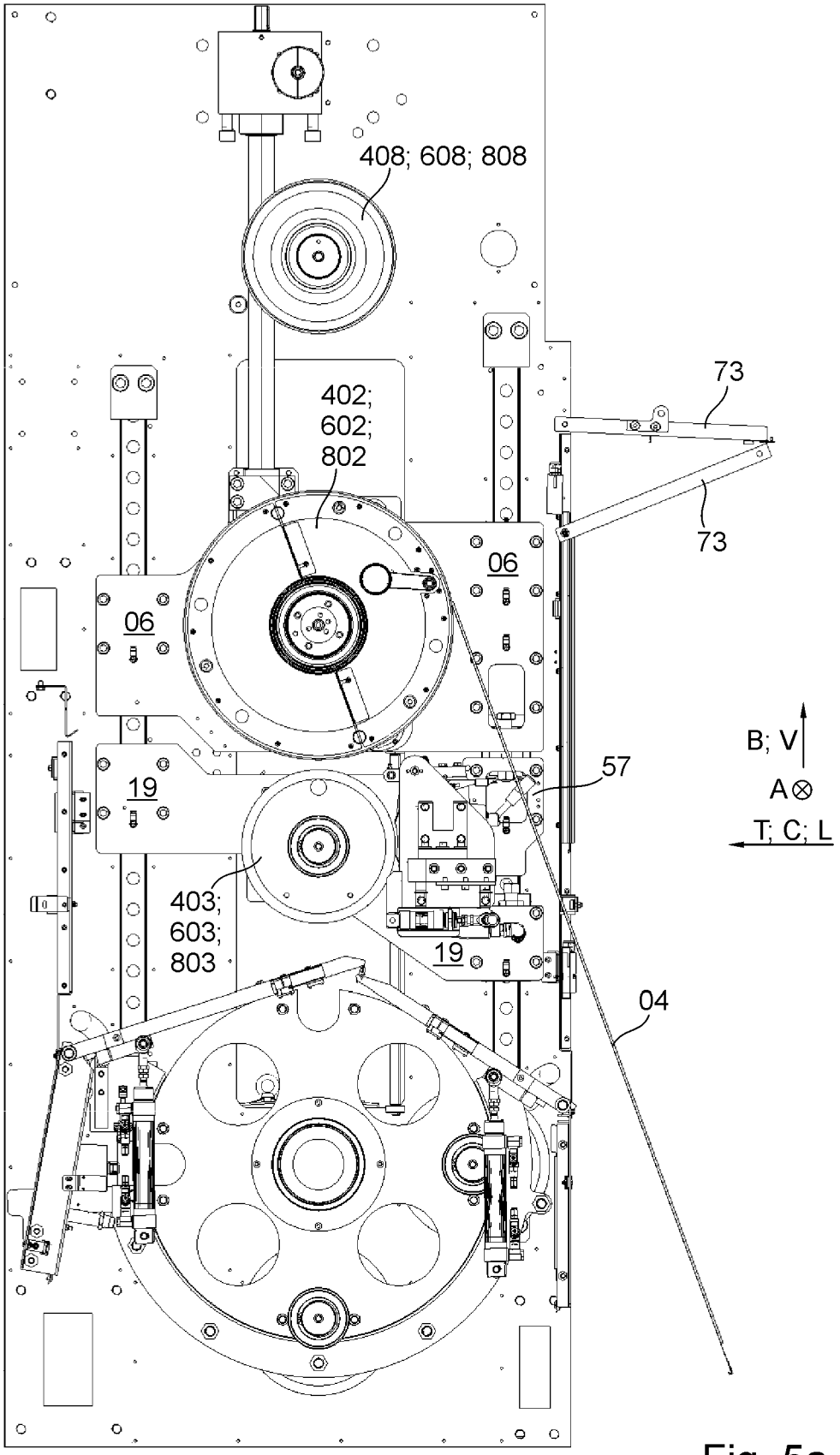
FIG. 5*a* a schematic representation of a flexographic application unit, in which a safety device is opened and a packing is in contact with the forme cylinder.
Figure 5B:
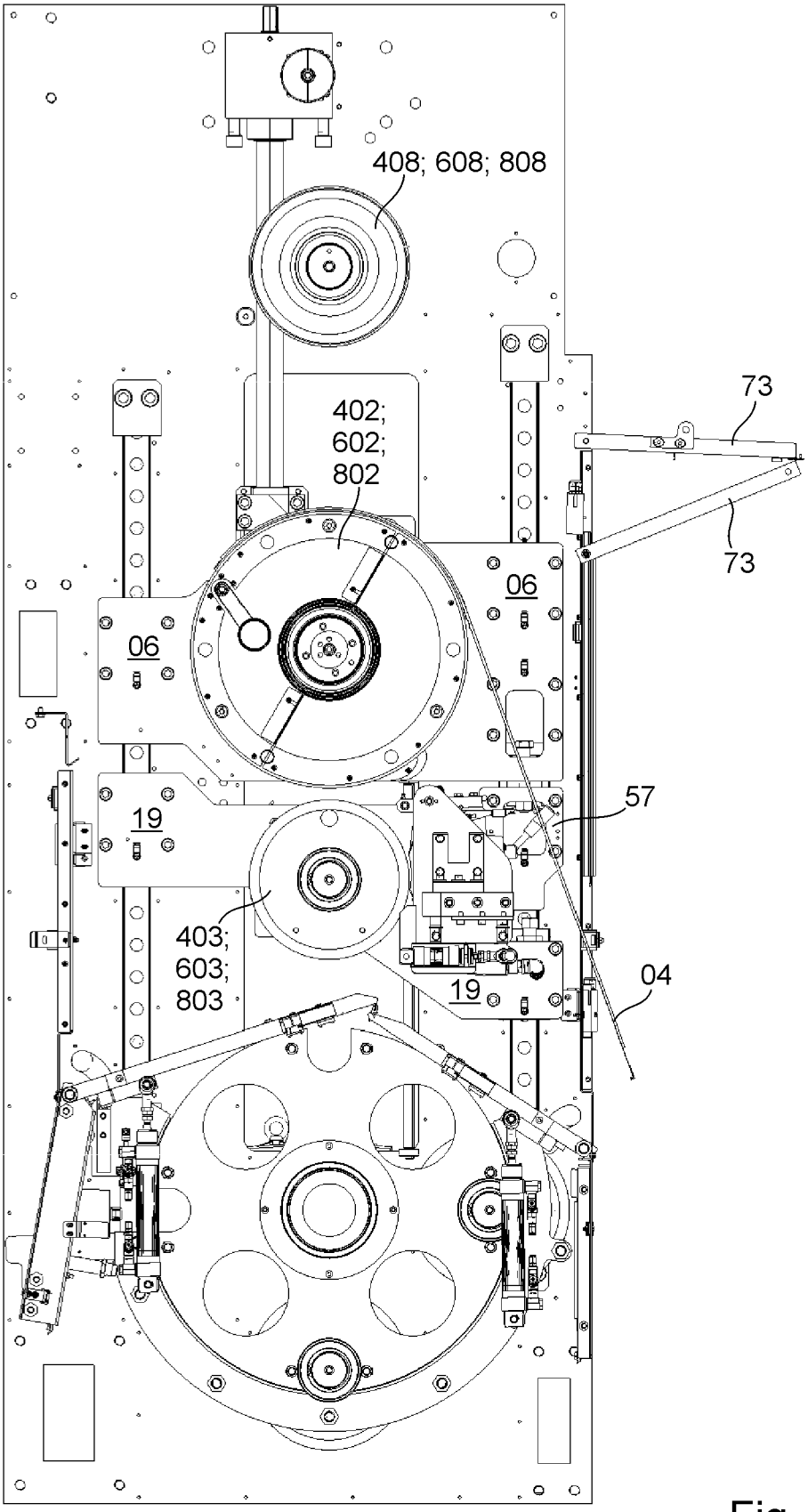
FIG. 5*b* a schematic representation according to FIG. 5*a*, in which the packing is partially mounted on the forme cylinder.
Figure 5C:
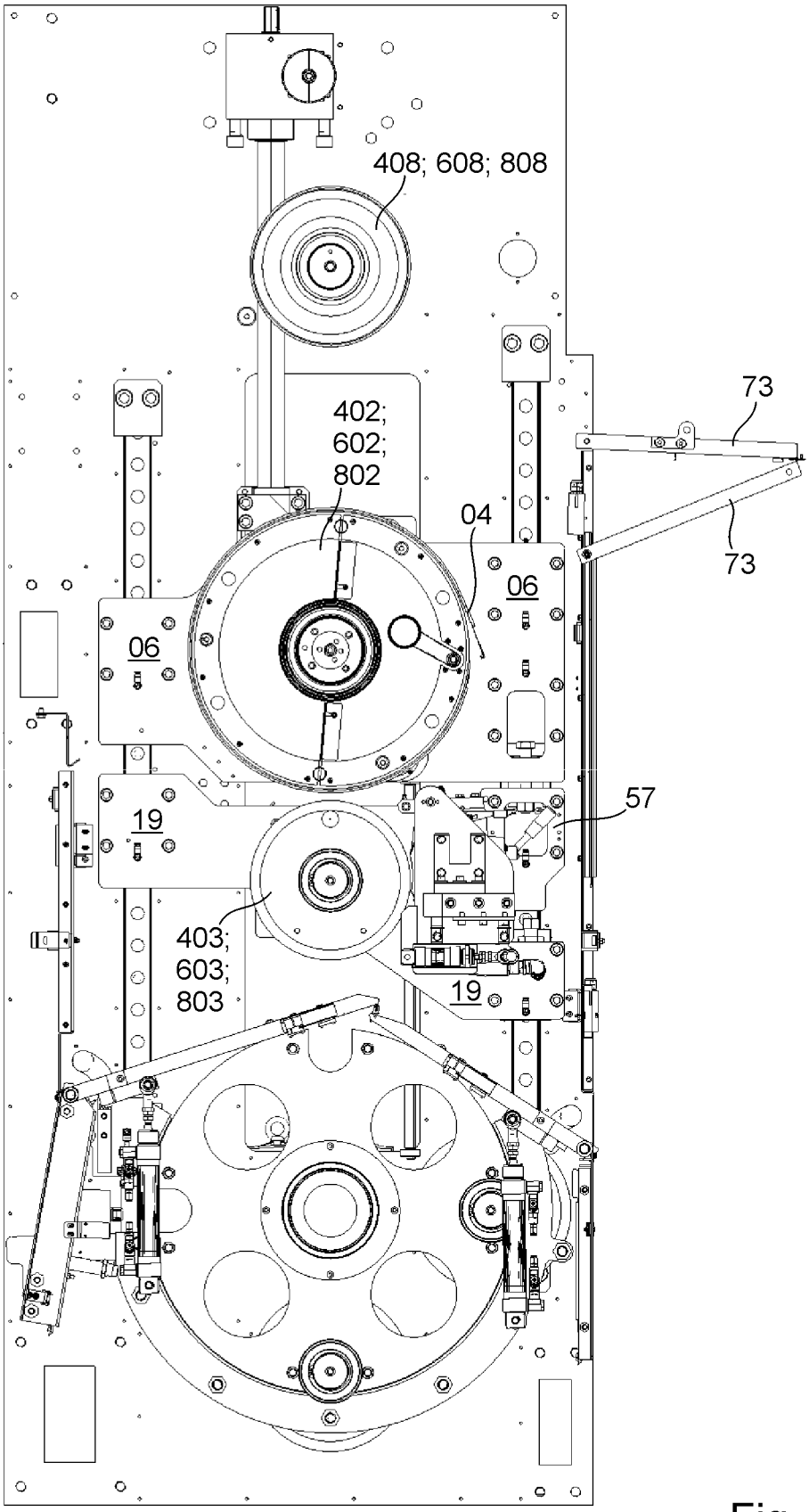
FIG. 5*c* a schematic representation according to FIG. 5*b*, in which the packing is mounted even further on the forme cylinder.
Figure 5D:
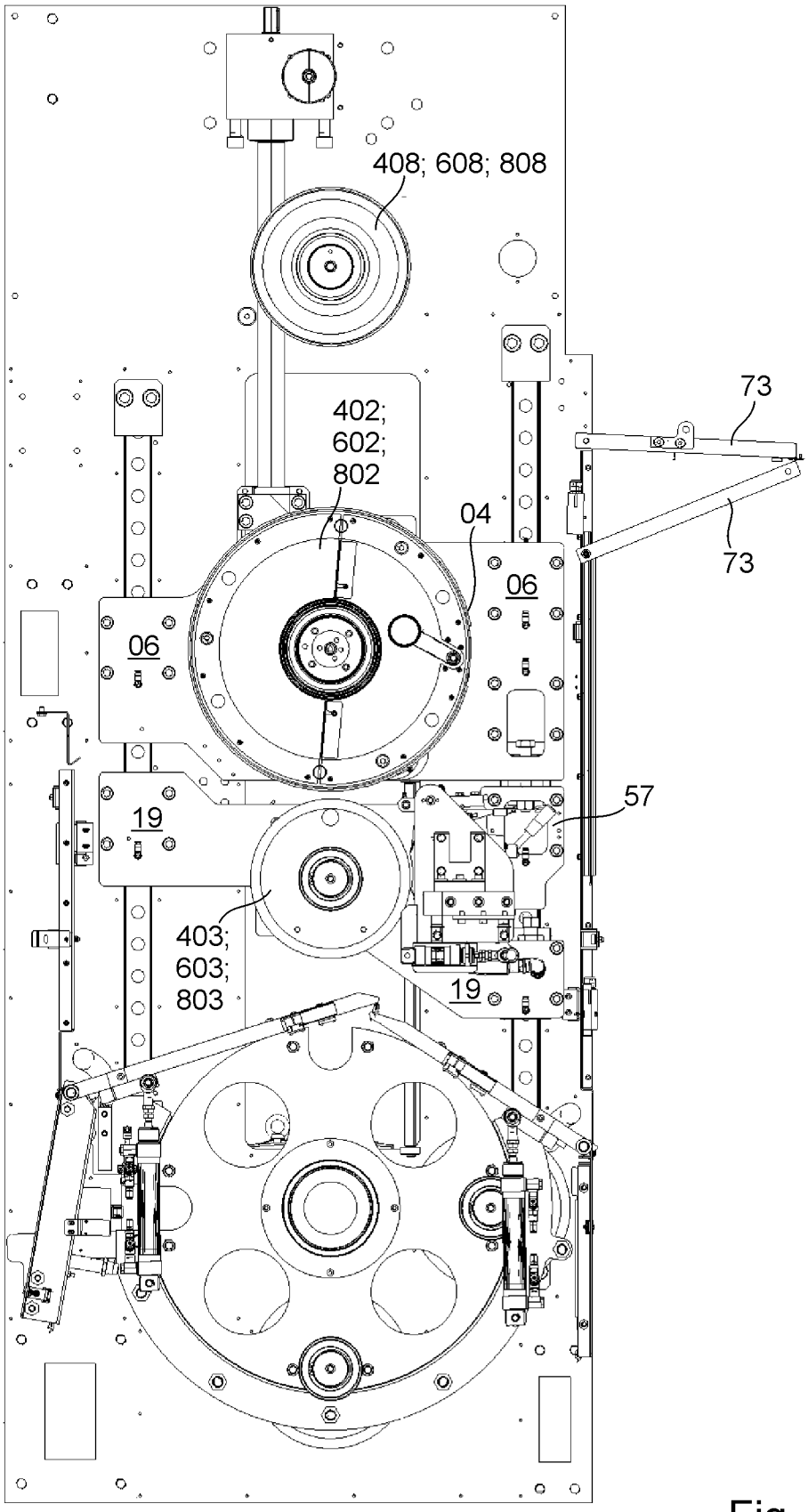
FIG. 5*d* a schematic representation according to FIG. 5*c*, in which the packing is fully mounted on the forme cylinder.
Figure 6A:
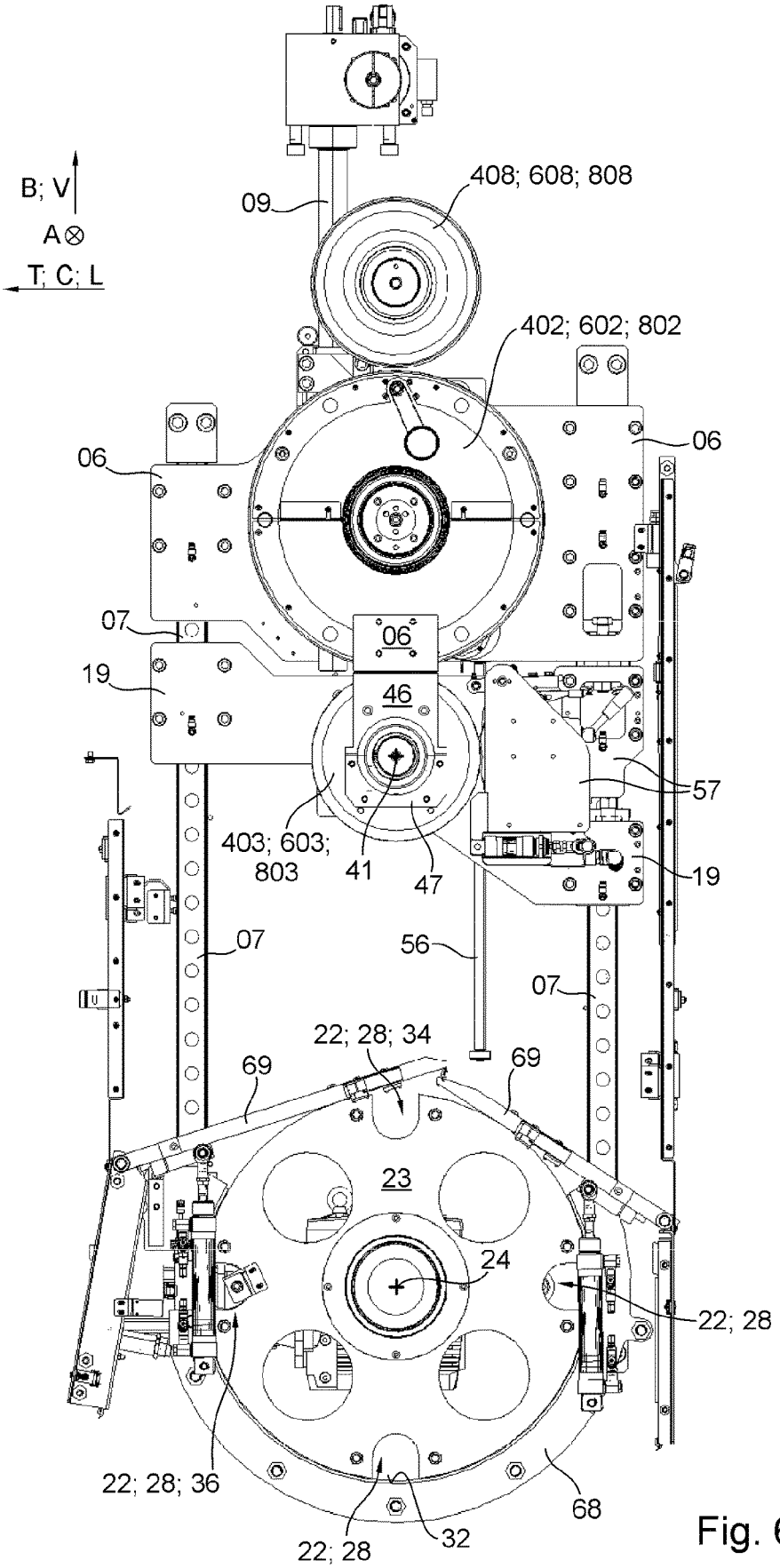
FIG. 6*a* a schematic representation of a flexographic application unit, in which a forme cylinder is arranged in an application position and a supply roller is thrown onto the forme cylinder and/or the packing thereof, an application fluid reservoir is arranged cooperating with the supply roller, and a covering device is closed.
Figure 6B:
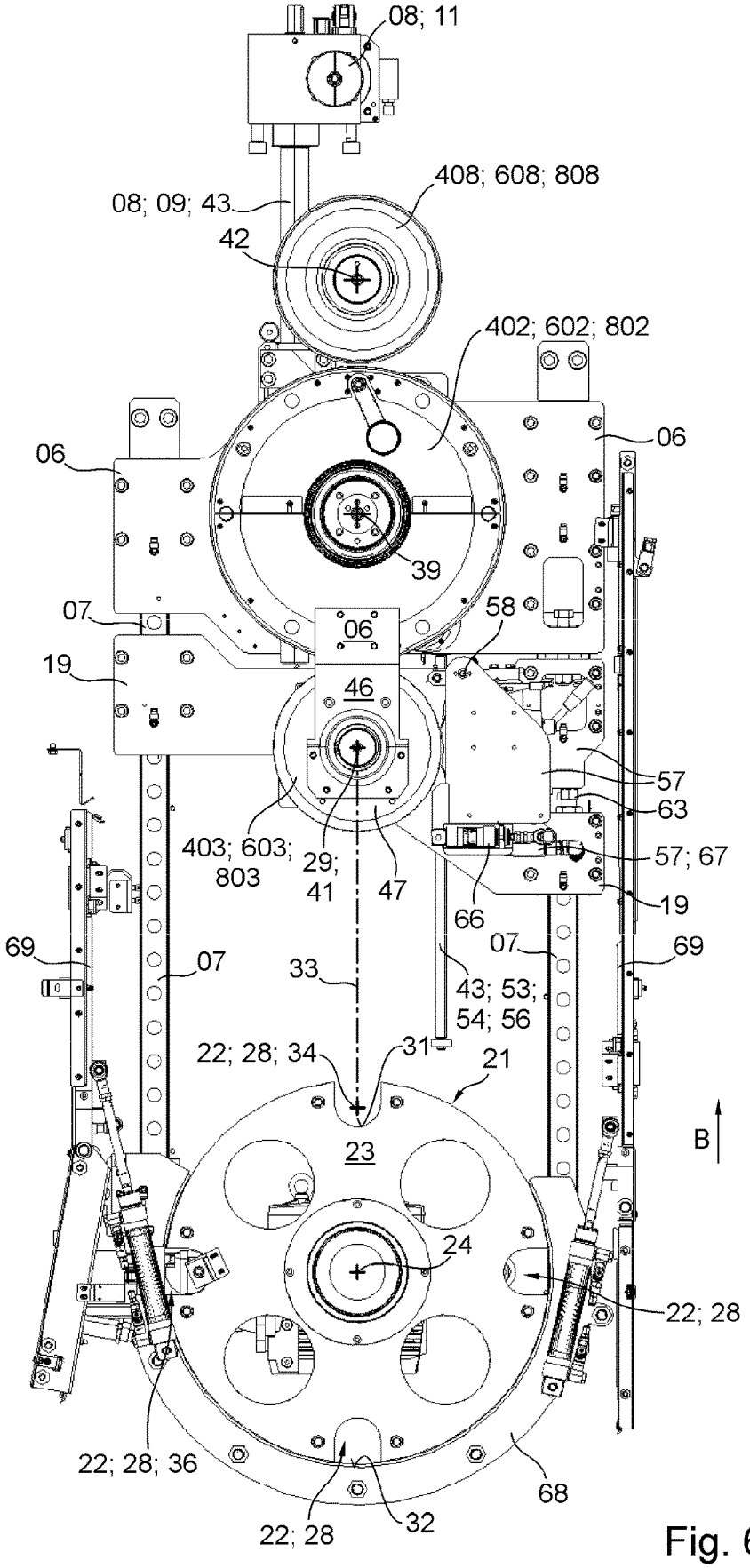
FIG. 6*b* a schematic representation according to FIG. 6*a*, in which the covering device is opened.
Figure 6C:
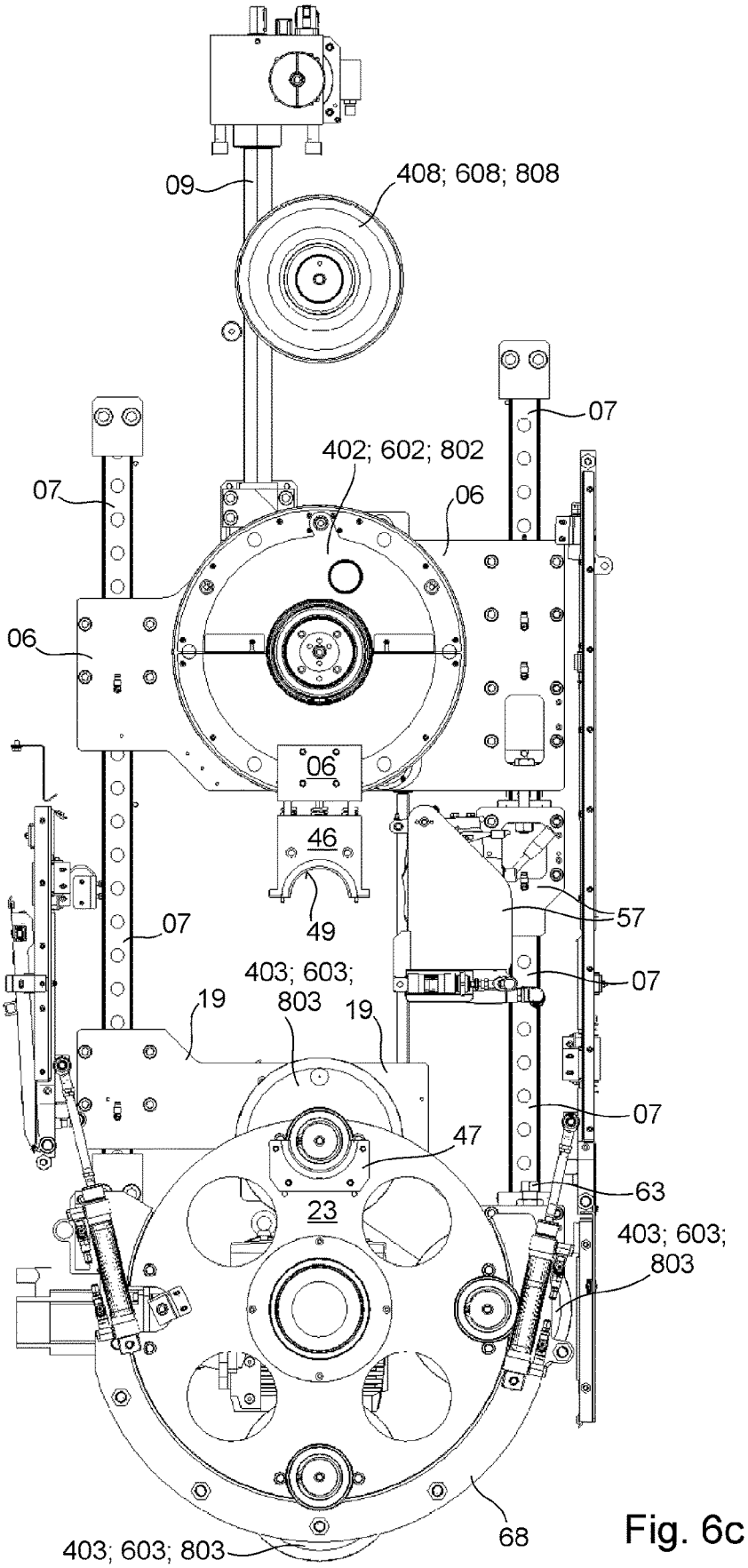
FIG. 6*c* a schematic representation according to FIG. 6*b*, in which the forme cylinder is backed further away from the impression cylinder and the supply roller is arranged in a magazine receptacle of a magazine and at the same time is in contact with a transfer supporting member.
Figure 6D:
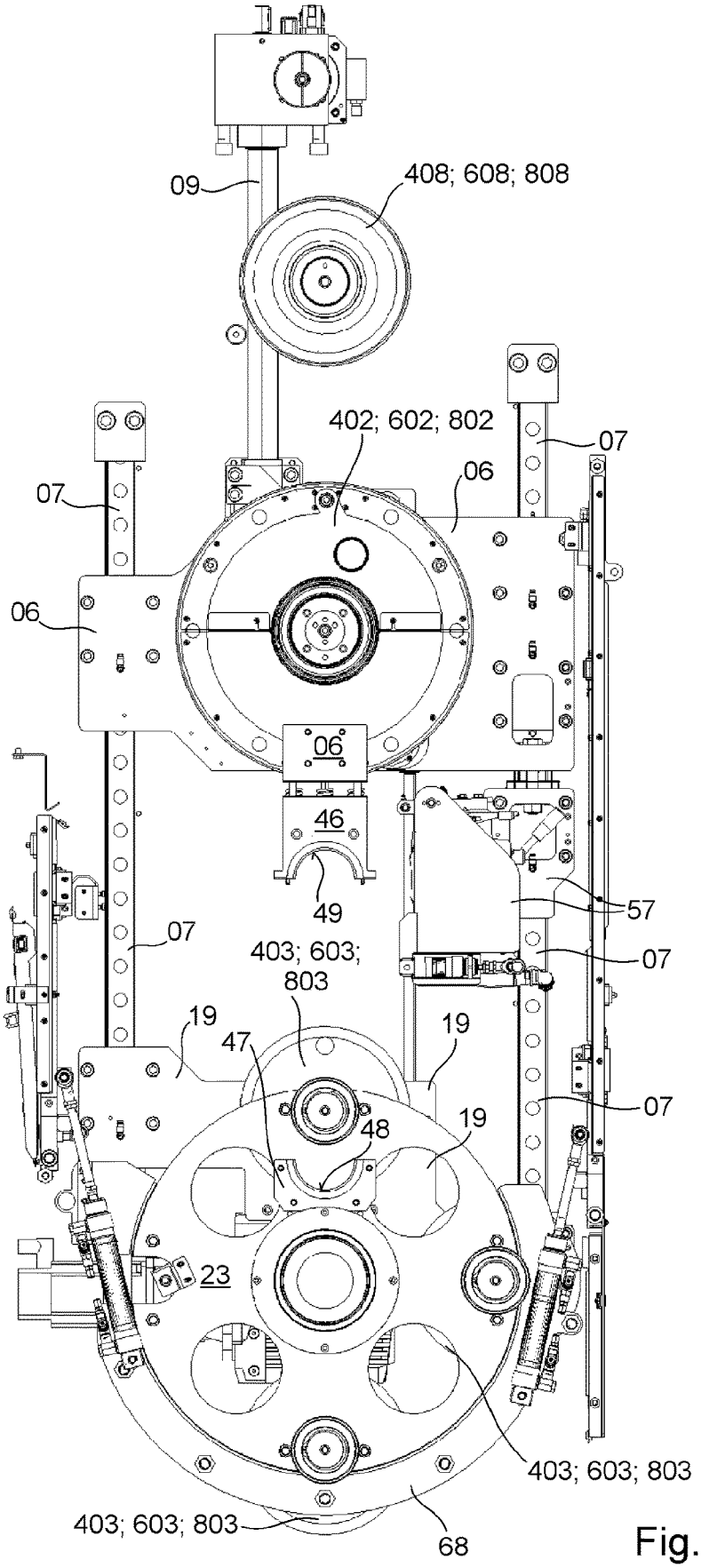
FIG. 6*d* a schematic representation according to FIG. 6*c*, in which the transfer supporting member is moved away from the supply roller.
Figure 6E:
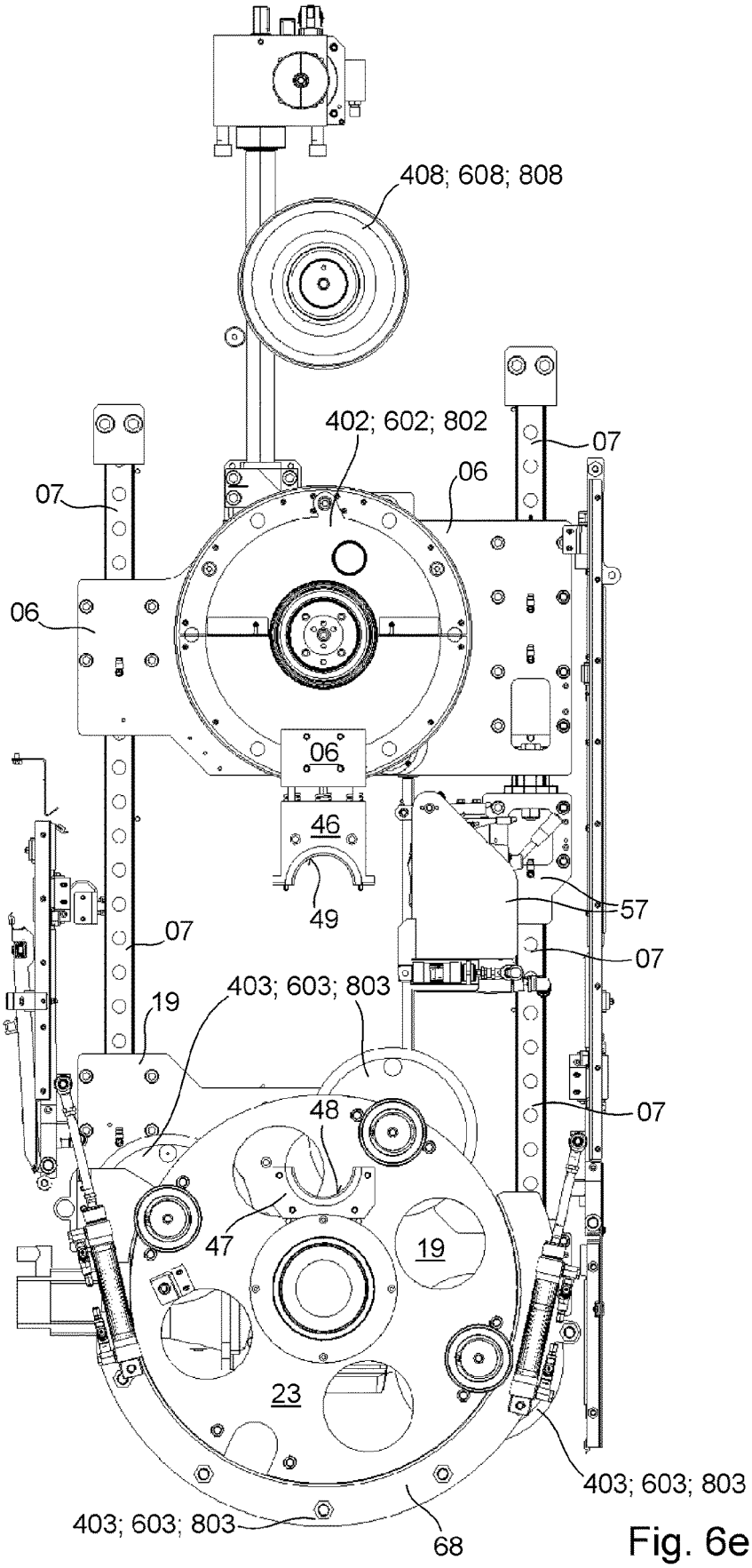
FIG. 6*e* a schematic representation according to FIG. 6*d*, in which magazine receptacles of the magazine are arranged in altered magazine positions.
Figure 7:
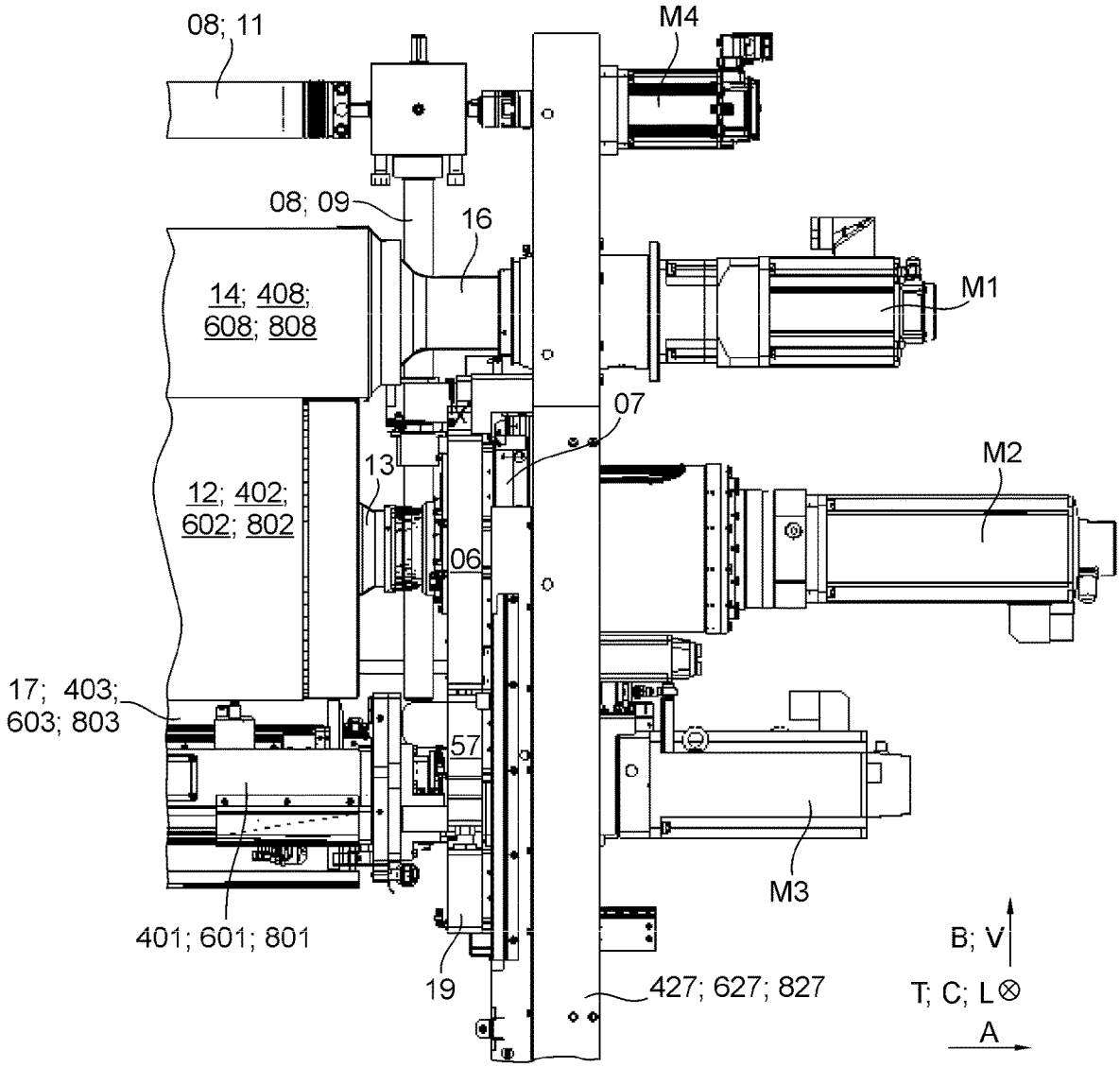
FIG. 7 a schematic representation of a portion of an application unit.
Figure 8A:
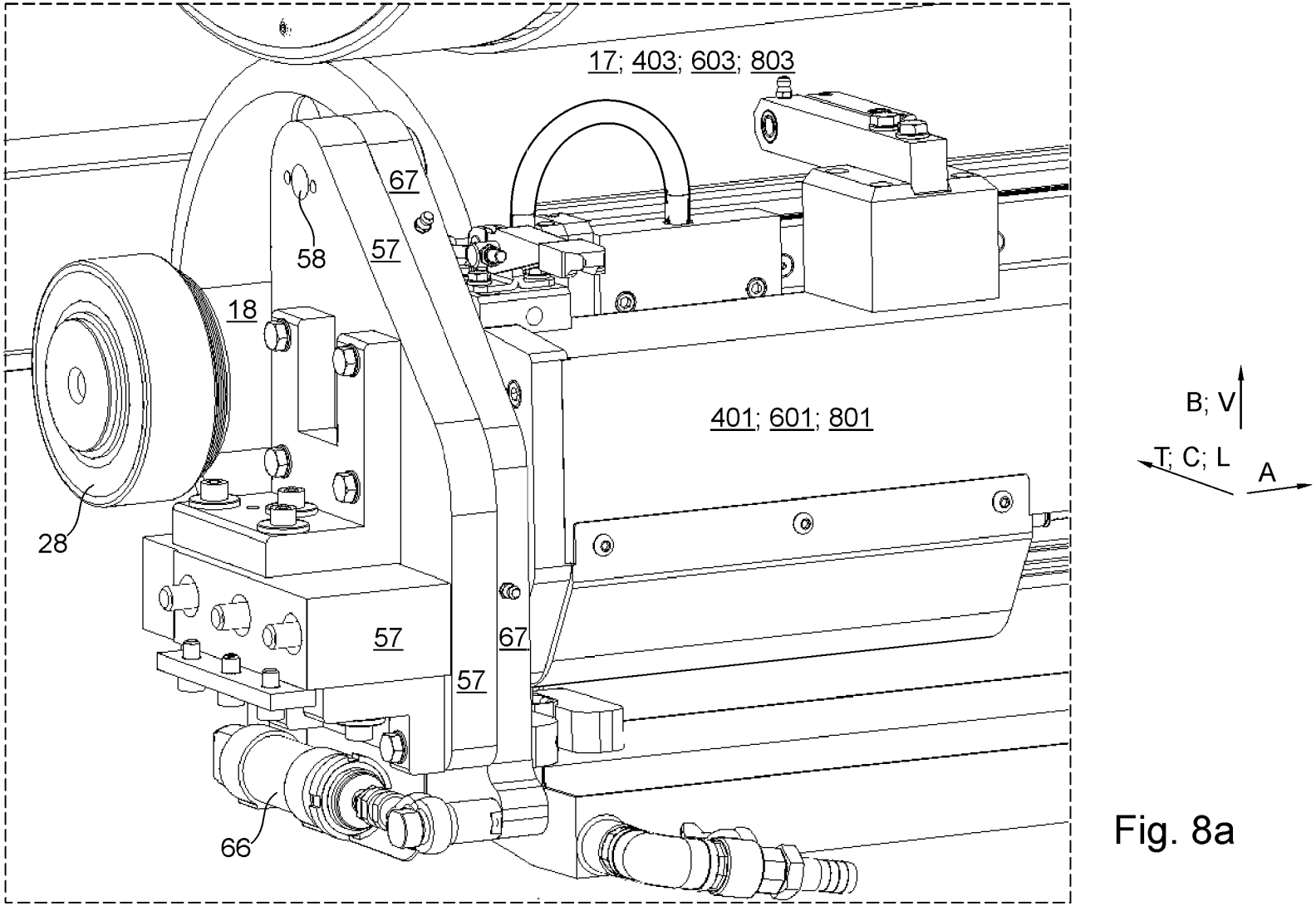
FIG. 8*a* a schematic representation of a reservoir supporting member and the area surrounding it on one side of the application unit.
Figure 8B:
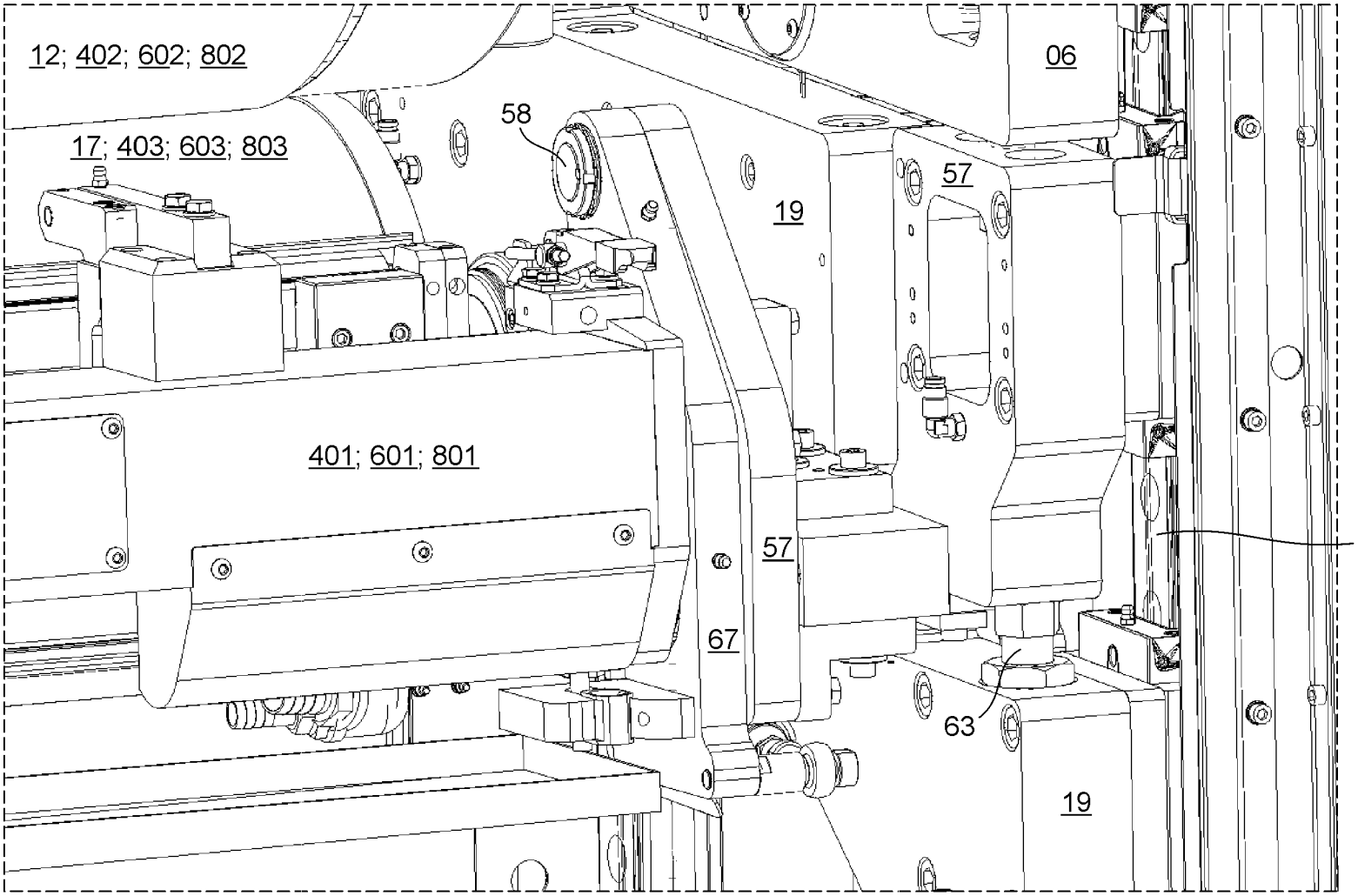
FIG. 8*b* a schematic representation according to FIG. 8*a* on another side of the application unit.

Supply rollers 403; 603; 803 are preferably moved between the loading position 36 and other magazine positions 28, preferably by means of the at least one repositioning device 23. At least one delivery device 71 can be arranged in the loading area 38, for example, for the purpose of exchanging supply rollers 403; 603; 803 between the magazine 21 and an area outside of the application unit 400; 600; 800. A transport cart 71 may be used as such a delivery device 71, for example. The application unit 400; 600; 800 preferably has at least one locking element 72, which separates the loading area 38 from the loading position 36 when no exchange of supply rollers 403; 603; 803 between loading area 38 and loading position 36 is planned. Further preferably, the at least one locking element 72 then serves at least partially as an outer boundary surface 32. The at least one locking element 72 can preferably be opened to enable an exchange of supply rollers 403; 603; 803 between loading area 38 and loading position 36. Further preferably, the at least one locking element 72 then serves at least partially as a supporting surface and/or to define the loading path 37. (For illustrative purposes only, one opened locking element and one closed locking element 72 are shown by way of example in each of FIGS. 4*a* to 4*c*. Preferably, however, these locking elements 72 are always either both opened or both closed.)

In a first exemplary embodiment of the processing machine 01, the processing machine 01 comprises a substrate supply device 100, an infeed device 300, multiple flexographic application units 600 preferably configured as flexographic printing mechanisms 600, a die-cutting device, and a substrate delivery device 1000. Transport devices 700 are preferably provided. The flexographic application mechanisms 600 are preferably used to apply application fluid from below. The transport devices 700 are preferably configured as suction transport devices 700 for the suspended transport of the substrate 02. The die-cutting device 900 preferably has a forme cylinder, which is arranged above an impression cylinder. (Such a processing machine 01 according to the first exemplary embodiment is also shown by way of example in FIG. 1.)

Figure 2:
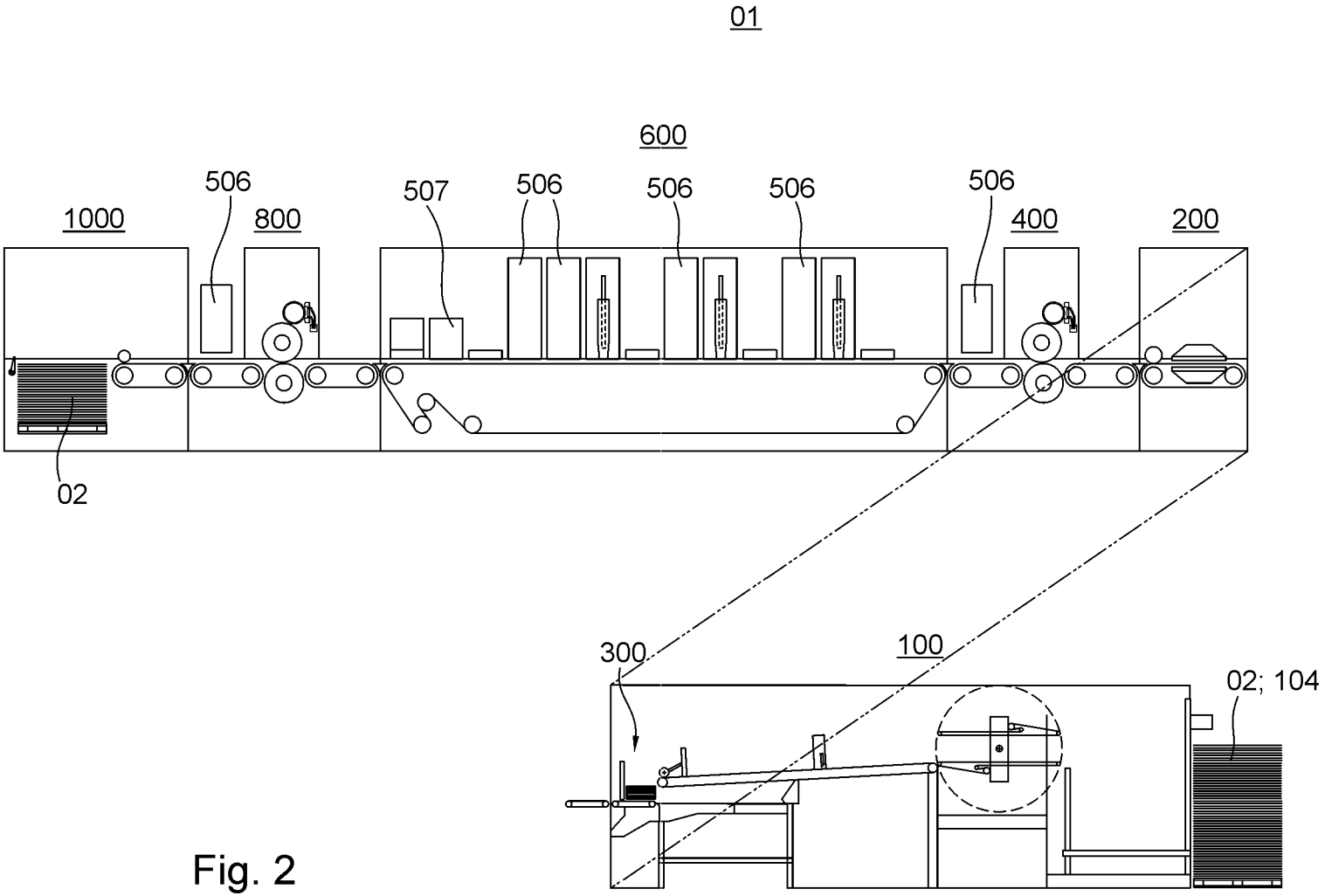
FIG. 2 a schematic representation of a processing machine with multiple flexographic application mechanisms and a non-impact printing unit.
Figure 3A:
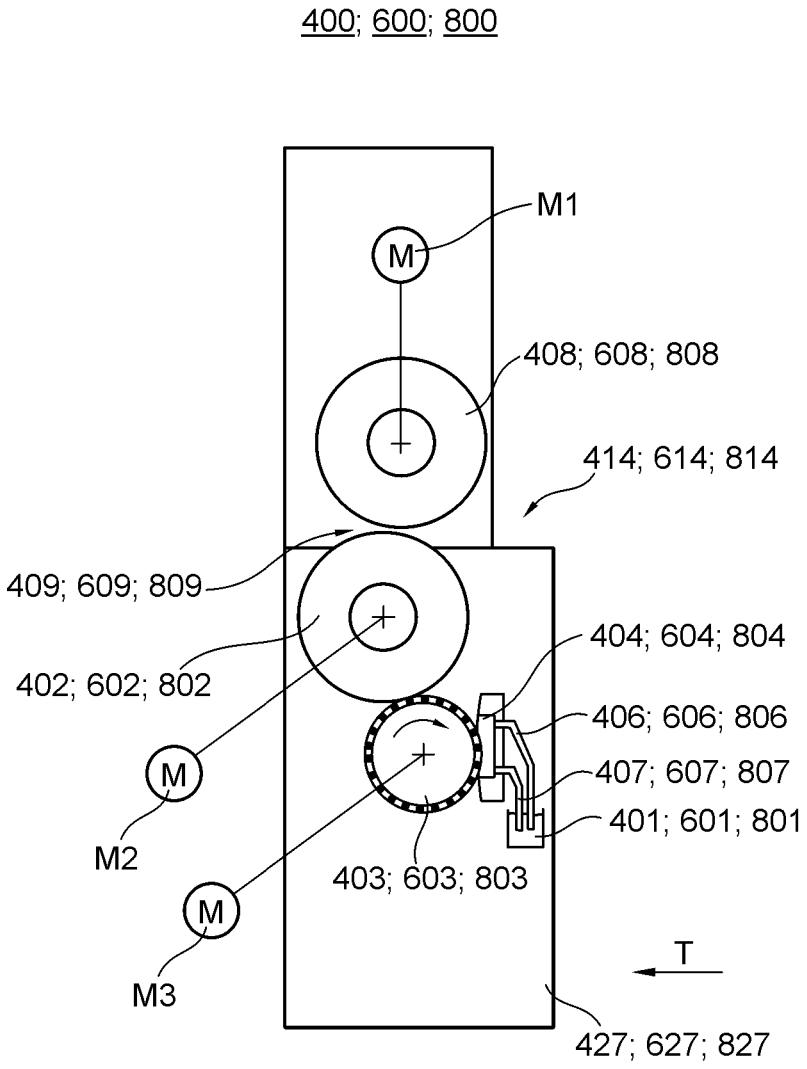
FIG. 3*a* a schematic representation of a flexographic application mechanism configured for application from below.
Figure 3B:
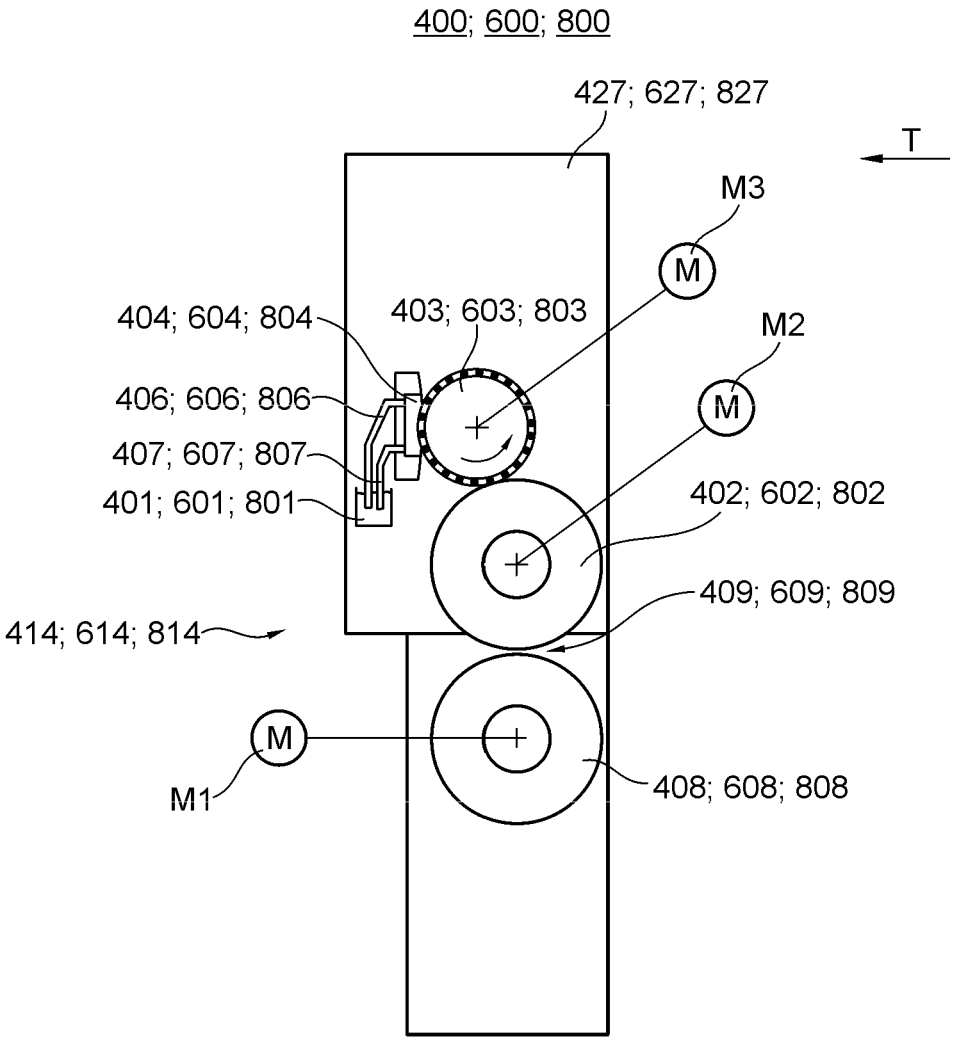
FIG. 3*b* a schematic representation of a flexographic application mechanism configured for application from above.

In a second exemplary embodiment of the processing machine 01, the processing machine 01 comprises a substrate supply device 100, an infeed device 300, for example a pre-processing device, a flexographic application unit 400 configured as a primer device 400, a non-impact printing device 600, a flexographic application unit 800 configured as a varnishing device 800, and a substrate delivery device 1000. Transport devices are preferably integrated into the respective units. The flexographic application mechanisms 400; 800 and the non-impact printing device 600 are preferably used to apply application fluid from above. The transport devices are preferably configured as suction transport devices and/or for transporting the substrate 02 in a flat position. (Such a processing machine 01 according to the second exemplary embodiment is also shown by way of example in FIG. 2.)

While preferred embodiments of an application unit with a positioning device and a magazine, in accordance with the present invention, have been set forth fully and completely hereinabove, it will be apparent to one of skill in the art that various changes could be made thereto, without departing from the true spirit and scope of the present invention, which is accordingly to be limited only by the appended claims.

The invention claimed is:

1. An application unit (400; 600; 800), wherein the application unit (400; 600; 800) comprises at least one application mechanism (414; 614; 814), which has at least one impression cylinder (408; 608; 808), at least one forme cylinder (402; 602; 802), and at least one supply roller (403; 603; 803), along with at least one positioning device (43), and wherein the at least one supply roller (403; 603; 803) can be moved along a linear roller positioning path (33) by means of the at least one positioning device (43), and wherein the roller positioning path (33) extends in and counter to a positioning direction (B), and wherein the application unit (400; 600; 800) has at least one magazine (21), located below the application mechanism (414; 614; 814), for the storing of supply rollers (403; 603; 803), and wherein the magazine (21) has at least two magazine receptacles (22), each for receiving one supply roller (403; 603; 803), and wherein the magazine (21) has at least one movable repositioning device (23), by means of which the at least two magazine receptacles (22) can be moved and placed in different magazine positions (28), and wherein at least one of the magazine positions (28) is a change position (34), and wherein when a magazine receptacle (22) is located in the change position (34), a supply roller (403; 603; 803) can be transferred, in or counter to the positioning direction (B), between said magazine receptacle (22), on the one hand, and a region, remote from said magazine (21), of a roller positioning path (33) that connects the magazine (21) to the application mechanism (414; 614; 814), on the other hand, characterized in that the positioning direction (B) deviates no more than 45° from at least one vertical direction (V), and in that at least one of the magazine positions (28) is a loading position (36), and in that when a magazine receptacle (22) is located in the loading position (36), a supply roller (403; 603; 803) can be transferred along a loading path (37), in or counter to a loading direction (L), between said magazine receptacle (22), on the one hand, and a loading area (38), on the other hand, and in that the loading direction (L) deviates no more than 30° from at least one horizontal direction (C).

2. The application unit according to claim 1, characterized in that the positioning direction (B) deviates no more than 30° and/or no more than 20° and/or no more than 10° and/or no more than 5° from at least one vertical direction (V) and/or is oriented parallel to the vertical direction (V), and/or in that the loading direction (L) deviates no more than 30° and/or no more than 20° and/or no more than 10° and/or no more than 5° from at least one horizontal direction (C) and/or is oriented horizontally, and/or in that the loading path (37) is configured as a linear loading path (37).

3. The application unit according to claim 1, characterized in that a supply position (29) is a position that is occupied by the at least one supply roller (403; 603; 803) arranged in the application mechanism (414; 614; 814) during an application process of the application mechanism (414; 614; 814), and in that by means of the at least one positioning device (43), at least one supply roller (403; 603; 803) can be moved along a linear roller positioning path (33), one end of which is identical to the supply position (29) and the other end of which is identical to one of the magazine positions (28; 34).

4. The application unit according to claim 1, characterized in that magazine receptacles (22) are at least also defined by at least one respective movable inner boundary surface (31) intended for contact with a roller journal (18) or a roller barrel (17) of a respective supply roller (403; 603; 803), and in that those magazine receptacles (22) that are arranged in a magazine position (28) of a first subset of all possible magazine positions (28) are additionally defined at least also by at least one respective stationary outer boundary surface (32) configured for contact with a roller journal (18) or a roller barrel (17) of a respective supply roller (403; 603; 803).

5. The application unit according to claim 4, characterized in that the at least one inner boundary surface (31) is a surface of the repositioning device (23), and/or in that the magazine (21) has at least one outer boundary member (68) that is arranged in a stationary manner, and the at least one outer boundary surface (32) is a surface (32) of the at least one outer boundary member (32).

6. The application unit according to claim 1, characterized in that the at least one repositioning device (23) is arranged to be pivotable and/or rotatable about a magazine axis (24), and/or in that the at least one repositioning device (23) has at least two recesses that form magazine receptacles (22), and/or in that the at least one outer boundary surface (32) is shaped such that its projection in the transverse direction (A) corresponds to a circular arc.

7. The application unit according to claim 1, characterized in that the positioning device (43) has at least one linear guide.

8. The application unit according to claim 7, characterized in that the positioning device (43) has at least one transfer supporting member (19), and in that the at least one transfer supporting member (19) is arranged to be movable in and/or counter to a positioning direction (B) relative to a frame (427; 627; 827) of the flexographic application mechanism (414; 614; 814), guided by the at least one linear guide (07), and in that at least one component (47) of a bearing seat (44) is arranged on the at least one transfer supporting member (19), which bearing seat is configured to receive a rolling bearing (27) arranged on the at least one supply roller (403; 603; 803).

9. The application unit according to claim 8, characterized in that the positioning device (43) has at least one main supporting member (06), and in that the at least one main supporting member (06) is arranged to be movable in and/or counter to a positioning direction (B), guided by the at least one linear guide (07), and in that the forme cylinder (402; 406; 408) is arranged rotatably on the at least one main supporting member (06) by means of at least one rolling bearing (26), and in that the at least one transfer supporting member (19) is arranged to be movable in and/or counter to the positioning direction (B) relative to the at least one main supporting member (06), guided by said at least one linear guide (07).

10. The application unit according to claim 9, characterized in that the positioning device (43) has at least one reservoir supporting member (57), and in that the at least one reservoir supporting member (57) is arranged to be movable in and/or counter to the positioning direction (B), both relative to the at least one main supporting member (06) and relative to the at least one transfer supporting member (19), guided by the at least one linear guide (07), and in that an intermediate reservoir (404; 604; 804) for application fluid is arranged on the at least one reservoir supporting member (57).

11. The application unit according to claim 10, characterized in that the reservoir supporting member (57) is located at least partially between the at least one main supporting member (06) and the at least one transfer supporting member (19), as viewed in the positioning direction (B).

12. The application unit according to claim 10, characterized in that the at least one main supporting member (06) is arranged guided by the same at least one linear guide (07) as the at least one transfer supporting member (19), and/or in that the at least one main supporting member (06) is arranged guided by the same at least one linear guide (07) as the at least one reservoir supporting member (57), and/or in that the at least one reservoir supporting member (57) is arranged guided by the same at least one linear guide (07) as the at least one reservoir supporting member (57).

13. The application unit according to claim 10, characterized in that the application unit (400; 600; 800) has at least one main position adjustment device, by means of which the relative position of the at least one main supporting member (06) relative to a frame (427; 627; 827) of the application unit (400; 600; 800) is determined, and in that the main position adjustment device comprises at least one main positioning drive (M4).

14. The application unit according to claim 10, characterized in that the application unit (400; 600; 800) has at least one transfer position adjustment device, by means of which the relative position of the at least one transfer supporting member (19) relative to the at least one main supporting member (06) of the application unit (400; 600; 800) is determined, and in that the transfer position adjustment device comprises at least one transfer drive (M6).

15. The application unit according to claim 1, characterized in that the magazine (21) has at least three and/or at least four magazine receptacles (22), each for receiving one supply roller (403; 603; 803), and/or in that a magazine receptacle (22) is understood as a defined spatial area that is intended to receive one supply roller (403; 603; 803).

* * * * *